US008887519B2

(12) United States Patent
Sakashita

(10) Patent No.: US 8,887,519 B2
(45) Date of Patent: Nov. 18, 2014

(54) CEILING-EMBEDDED AIR CONDITIONING INDOOR UNIT

(75) Inventor: Akihiko Sakashita, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 680 days.

(21) Appl. No.: 13/139,334

(22) PCT Filed: Dec. 15, 2009

(86) PCT No.: PCT/JP2009/006900

§ 371 (c)(1),
(2), (4) Date: Jun. 13, 2011

(87) PCT Pub. No.: WO2010/070889

PCT Pub. Date: Jun. 24, 2010

(65) Prior Publication Data

US 2011/0240255 A1 Oct. 6, 2011

(30) Foreign Application Priority Data

Dec. 15, 2008 (JP) ..... 2008-317842

(51) Int. Cl.

| | |
|---|---|
| ***F24F 1/02*** | (2011.01) |
| ***F24F 13/28*** | (2006.01) |
| *F24F 1/00* | (2011.01) |
| *F25D 17/06* | (2006.01) |

(52) U.S. Cl.

CPC ..... *F24F 13/28* (2013.01); *F24F 2001/0037* (2013.01); *F25D 17/065* (2013.01); *F24F 1/02* (2013.01); *F24F 1/0007* (2013.01)

USPC ..... 62/259.1

(58) Field of Classification Search

CPC ..... F24F 13/00; F24F 1/0014

USPC ..... 62/259.1, 407, DIG. 16, 418, 419, 427, 62/428

See application file for complete search history.

(56) References Cited

U.S. PATENT DOCUMENTS

2004/0172962 A9* 9/2004 Kosugi et al. ..... 62/285
2006/0070658 A1* 4/2006 Nakata et al. ..... 137/312

FOREIGN PATENT DOCUMENTS

EP WO 2008111372 A1 * 9/2008 ..... F04D 17/06
GB 2314924 A * 1/1998 ..... F24F 1/00

(Continued)

OTHER PUBLICATIONS

International Preliminary Report of corresponding PCT Application No. PCT/JP2009/006900.

(Continued)

*Primary Examiner* — Frantz Jules
*Assistant Examiner* — Emmanuel Duke
(74) *Attorney, Agent, or Firm* — Global IP Counselors

(57) ABSTRACT

A ceiling-embedded air conditioning indoor unit conditions air above a ceiling of a target space that is supplied to the target space. The ceiling has a grid shaped frame. The air conditioning indoor unit includes an indoor unit casing, a fan and a heat exchanger. The indoor unit casing has a suction port disposed in at least part of a side surface and a blow-out port disposed in at least part of an undersurface. The undersurface is substantially rectangle shaped with each side being equal to or less than 600 mm long. The fan is inside the indoor unit casing to form an air flow leading from the suction port to the blow-out port. The heat exchanger is between the fan and the suction port. An outer edge of the undersurface is on an inner side of an inner edge of the frame or along the frame.

18 Claims, 25 Drawing Sheets

(56) References Cited

FOREIGN PATENT DOCUMENTS

| | | | | | |
|---|---|---|---|---|---|
| JP | 07243662 | | * | 9/1995 | ..... F24F 1/00 |
| JP | 2000-124365 | A | | 4/2000 | |
| JP | 2000-193264 | A | | 7/2000 | |
| JP | 2003240330 | | * | 8/2003 | ..... F24F 1/00 |
| JP | 2006-138575 | A | | 6/2006 | |
| JP | 2006138575 | | * | 6/2006 | ..... F24F 1/00 |
| WO | WO-2008/126230 | A1 | | 10/2008 | |
| WO | WO2008126230 | | * | 10/2008 | ..... F24F 1/00 |
| WO | WO 2008126230 | A1 | * | 10/2008 | ..... F24F 1/00 |

OTHER PUBLICATIONS

International Search Report of corresponding PCT Application No. PCT/JP2009/006900.

* cited by examiner

CEILING-EMBEDDED AIR CONDITIONING INDOOR UNIT

CROSS-REFERENCE TO RELATED APPLICATIONS

This U.S. National stage application claims priority under 35 U.S.C. §119(a) to Japanese Patent Application No. 2008-317842, filed in Japan on Dec. 15, 2008, the entire contents of which are hereby incorporated herein by reference.

TECHNICAL FIELD

The present invention relates to a ceiling-embedded air conditioning indoor unit.

BACKGROUND ART

Conventionally, there have existed indoor units of air conditioning apparatus that are installed so as to be embedded in the ceiling of a room and used.

For example, in the indoor unit described in Japanese Patent Publication No. 2001-124365 below, there is proposed a structure that sucks in room air from a square suction port disposed in the center of an undersurface of the indoor unit and blows out conditioned air, whose temperature has been conditioned as a result of the air being passed through a heat exchanger, into the room from blow-out ports disposed around, and in the same surface as, the suction port.

SUMMARY

Technical Problem

In the indoor unit of the air conditioning apparatus described in Japanese Publication No. 2001-124365, the suction port and the blow-out ports are disposed on the undersurface side of the indoor unit, which is the same surface.

In terms of the structure of the suction port and the blow-out ports in this indoor unit, the problem of a short circuit does not become pronounced in a conventional indoor unit where one side of the undersurface is about 900 mm.

However, when attempting to miniaturize an indoor unit with the same structure as that of the indoor unit of the air conditioning apparatus described above until one side of the undersurface becomes equal to or less than 600 mm, the distance between the suction port and the blow-out ports becomes shorter. For this reason, the problem of a short circuit, where the indoor unit ends up sucking the conditioned air back through the suction port before the conditioned air that is to be blown out from the blow-out ports is supplied to the entire room, arises.

Further, regarding ceiling-embedded air conditioning indoor units that are installed so as to be embedded in a ceiling, facilitating the installation work has conventionally been desired.

The present invention has been made in light of the aforementioned point, and it is a problem of the present invention to provide a ceiling-embedded air conditioning air indoor unit that is capable of being easily installed with respect to a desired frame while miniaturizing the indoor unit to become an indoor unit whose length on one side is equal to or less than 600 mm while suppressing the occurrence of a short circuit.

Solution to the Problem

A ceiling-embedded air conditioning indoor unit of a first aspect of the invention is a ceiling-embedded air conditioning indoor unit that conditions the air in a space above a ceiling of an air conditioning target space and supplies the conditioned air to the air conditioning target space, and the ceiling-embedded air conditioning indoor unit comprises an indoor unit casing, a fan, and a heat exchanger. The indoor unit casing has a suction port disposed in at least part of a side surface thereof and a blow-out port disposed in at least part of an undersurface thereof, with the shape of the undersurface being substantially rectangle shaped and with one side being equal to or less than 600 mm. The fan is placed inside the indoor unit casing and forms an air flow leading from the suction port to the blow-out port. The heat exchanger is placed between the fan and the suction port. The ceiling has a grid-like frame. The outer edge of the undersurface of the indoor unit casing is placed so as to be positioned on the inner side of the inner edge of the frame or so as to be along the frame. The structure may be one where the outer edge of the undersurface of the indoor unit casing can be fitted into the inner edge of the frame. Further, the structure may be one where the outer edge of the undersurface of the indoor unit casing is supported by the inner edge of the frame.

In this ceiling-embedded air conditioning indoor unit, the suction port and the blow-out port in the indoor unit are not in the same surface, so the size of the indoor unit can be miniaturized compared to the conventional indoor unit where the blow-out ports had been disposed around, and in the same surface as, the suction port. Moreover, even in the case of miniaturizing the indoor unit in this way, the air that has been blown out into the air conditioning target space from the blow-out port is not immediately sucked back in from the suction port and can be retained in the conditioning target space because a wall configuring the ceiling exists between the suction port and the blow-out port disposed in the indoor unit casing. Because of this, it becomes possible to easily install the indoor unit with respect to a desired frame while miniaturizing the indoor unit to become an indoor unit whose length on one side is equal to or less than 600 mm while suppressing the occurrence of a short circuit.

A ceiling-embedded air conditioning indoor unit of a second aspect of the invention is the ceiling-embedded air conditioning indoor unit of the first aspect of the invention, wherein the outer edge of the undersurface of the indoor unit casing is supported by the frame.

In this ceiling-embedded air conditioning indoor unit, the positioning and installation stability of the indoor unit casing can be improved because the outer edge of the undersurface of the indoor unit casing is supported by the grid-like frame located in the ceiling.

A ceiling-embedded air conditioning indoor unit of a third aspect of the invention is the ceiling-embedded air conditioning indoor unit of the first or second aspect of the invention, wherein the shape of the undersurface of the indoor unit casing is substantially square.

In this ceiling-embedded air conditioning indoor unit, the sizes of the surfaces configuring the suction port can be made the same, and it becomes possible to suppress differences in suction and to perform uniform air conditioning.

A ceiling-embedded air conditioning indoor unit of a fourth aspect of the invention is the ceiling-embedded air conditioning indoor unit of the first aspect of the invention, wherein the ceiling has a ceiling panel. The ceiling panel is placed such that its outer edge is positioned on the inner side of the inner edge of the frame or is along the frame. The outer edge of the undersurface of the indoor unit casing is placed so as to be positioned on the inner side of the edge of a cutaway portion of the ceiling panel or so as to follow the edge of the cutaway portion. The structure may be one where the outer edge of the ceiling panel can be fitted into the inner edge of the frame. Further, the structure may be one where the outer edge of the ceiling panel is supported by the inner edge of the frame. The structure may be one where the outer edge of the undersurface of the indoor unit casing can be fitted into the inner edge of the cutaway portion of the ceiling panel. Further, the structure may be one where the outer edge of the undersurface of the indoor unit casing is supported by the inner edge of the cutaway portion of the ceiling panel.

In this ceiling-embedded air conditioning indoor unit, it becomes possible to easily install the indoor unit just by cutting away, into a shape corresponding to the outer edge shape of the undersurface of the indoor unit casing, the ceiling panel in which the indoor unit casing is to be installed.

A ceiling-embedded air conditioning indoor unit of a fifth aspect of the invention is the ceiling-embedded air conditioning indoor unit of the fourth aspect of the invention, wherein the undersurface of the indoor unit casing is configured by an undersurface member. The undersurface member is positioned on a lower end of the indoor unit casing in an installed state of the indoor unit casing and is placed so as to face the air conditioning target space.

In this ceiling-embedded air conditioning indoor unit, the outer edge of the undersurface member of the indoor unit casing as seen in a plan view is placed so as to be positioned on the inner side of the edge of the cutaway portion of the ceiling panel or so as to be along the edge of the cutaway portion. Because of this, it becomes possible to make it easier for the edge of the cutaway portion of the ceiling panel and the outer edge of the undersurface member of the indoor unit casing to correspond to each other at the time of installation.

A ceiling-embedded air conditioning indoor unit of a sixth aspect of the invention is the ceiling-embedded air conditioning indoor unit of any of the first to fifth aspects of the invention, wherein the indoor unit casing has a non-suction side surface in which the suction port is not disposed.

In this ceiling-embedded air conditioning indoor unit, it becomes easier to ensure, on the non-suction side surface side, working space that becomes necessary at the time of maintenance.

A ceiling-embedded air conditioning indoor unit of a seventh aspect of the invention is the ceiling-embedded air conditioning indoor unit of the sixth aspect of the invention, wherein the non-suction side surface has an access port that enables access to the inside of the indoor unit casing.

In this ceiling-embedded air conditioning indoor unit, access to the inside of the indoor unit casing via the access port becomes even easier by ensuring, on the non-suction side surface side, working space that becomes necessary at the time of maintenance.

A ceiling-embedded air conditioning indoor unit of an eighth aspect of the invention is the ceiling-embedded air conditioning indoor unit of the sixth or seventh aspect of the invention, wherein the portion of the heat exchanger near the non-suction side surface is placed so as to become closer to the suction port side surface with increasing distance away from the non-suction side surface.

In this ceiling-embedded air conditioning indoor unit, the non-suction side surface in which the suction port is not disposed and the portion of the heat exchanger placed near the non-suction side surface are placed so as to not become parallel as seen in a top view. For this reason, it becomes easier for the air that has been taken in via the suction port to be supplied to the nonparallel-placed portion of the heat exchanger near the non-suction side surface. Because of this, even in a case where the non-suction side surface in which the suction port is not disposed is disposed, the heat exchange efficiency can be improved.

A ceiling-embedded air conditioning indoor unit of a ninth aspect of the invention is the ceiling-embedded air conditioning indoor unit of any of the sixth to eighth aspects of the invention, wherein the heat exchanger has a heat transfer pipe that extends from one end to another end. One end and another end of the heat transfer pipe are disposed so as to penetrate the non-suction side surface.

In this ceiling-embedded air conditioning indoor unit, an increase in the dimension in the vertical direction of the indoor unit casing can be prevented by allowing the heat transfer pipe to penetrate the side surface of the indoor unit casing. Additionally, because the heat transfer pipe is placed so as to penetrate the non-suction side surface without penetrating the blow-out side surface, it is difficult for the heat transfer pipe to become resistance to the air flow formed by the fan and an increase in the ventilation resistance can be kept small.

A ceiling-embedded air conditioning indoor unit of a tenth aspect of the invention is the ceiling-embedded air conditioning indoor unit of any of the sixth to ninth aspects of the invention, further comprising an electrical component portion that performs drive control of at least the fan. The electrical component portion is placed on the outer side of the non-suction side surface and is fixed to the non-suction side surface.

In this ceiling-embedded air conditioning indoor unit, an increase in the ventilation resistance can be kept small by gathering together and placing the electrical component portion and the heat transfer pipe near the same side surface of the indoor unit casing. Further, the installability of the indoor unit can be improved because the portions that project outward from the side surface of the indoor unit casing are arranged in the same direction.

A ceiling-embedded air conditioning indoor unit of an eleventh aspect of the invention is the ceiling-embedded air conditioning indoor unit of any of the sixth to tenth aspects of the invention, further comprising a drain portion that collects drain water arising in the heat exchanger, penetrates the non-suction side surface, and extends outward.

In this ceiling-embedded air conditioning indoor unit, an increase in the ventilation resistance can be kept small by gathering together and placing the drain portion and the heat transfer pipe near the same side surface of the indoor unit casing. Further, the installability of the indoor unit can be improved because the portions that project outward from the side surface of the indoor unit casing are arranged in the same direction.

A ceiling-embedded air conditioning indoor unit of a twelfth aspect of the invention is the ceiling-embedded air conditioning indoor unit of any of the first to ninth aspects of the invention, further comprising an electrical component portion. The electrical component portion performs drive control of at least the fan. All of the side surface of the electrical component portion on the heat exchanger side is placed so as to be positioned on an upwind side of the heat exchanger in a state where the fan has been driven.

In this ceiling-embedded air conditioning indoor unit, all of the side surface of the electrical component portion on the heat exchanger side is placed so as to be positioned on the upwind side of the heat exchanger rather than being placed so as to straddle the upwind side and the downwind side of the heat exchanger. For this reason, differences in the temperature of the air passing around can be kept small in the side surface of the electrical component portion on the heat exchanger side. Because of this, dew condensation forming on the side surface of the electrical component portion on the heat exchanger side can be suppressed, and the need to dispose a heat insulating material on the inner side of the side surface of the electrical component portion on the heat exchanger side can be eliminated.

A ceiling-embedded air conditioning indoor unit of a thirteenth aspect of the invention is the ceiling-embedded air conditioning indoor unit of any of the first to ninth aspects of the invention, wherein the indoor unit casing has an access port that is disposed so as to face a space positioned on a downwind side of the heat exchanger in a state where the fan has been driven and enables access to the inside of the indoor unit casing.

In this ceiling-embedded air conditioning indoor unit, even in a case where a service engineer or a user maintains parts and so forth installed on the downstream side of the heat exchanger, it becomes possible to access the parts and so forth without having to remove the heat exchanger by inserting an arm or the like via the access port.

A ceiling-embedded air conditioning indoor unit of a fourteenth aspect of the invention is the ceiling-embedded air conditioning indoor unit of any of the first to ninth aspects of the invention, further comprising a drain pipe and an electrical component portion. The drain pipe collects and drains drain water arising in the heat exchanger. The electrical component portion performs drive control of at least the fan. The heat exchanger has a heat transfer pipe that extends from one end to another end. The indoor unit casing has a through surface in which an access port that enables access to the inside of the indoor unit casing is disposed. The drain pipe penetrates the through surface, the heat transfer pipe penetrates the through surface, and the electrical component portion is mounted on the through surface.

In this ceiling-embedded air conditioning indoor unit, the drain pipe and the heat transfer pipe penetrate, and the electrical component portion is mounted on, the through surface in which the access port is disposed. For this reason, a service engineer or a user can perform maintenance on the inside of the indoor unit casing via the access port, maintenance on the drain pipe, maintenance on the heat transfer pipe, and maintenance on the electrical component portion just by accessing them from the outer side of the through surface. For this reason, the trouble of changing the access direction with each maintenance target can be saved.

A ceiling-embedded air conditioning indoor unit of a fifteenth aspect of the invention is the ceiling-embedded air conditioning indoor unit of any of the first to fourteenth aspects of the invention, wherein the axial direction of the fan is substantially parallel to a perpendicular direction of the undersurface of the indoor unit casing and the fan is at least either one of a turbo fan and a propeller fan.

In this ceiling-embedded air conditioning indoor unit, it is easy to ensure the air volume even in a case where the indoor unit has been miniaturized.

A ceiling-embedded air conditioning indoor unit of a sixteenth aspect of the invention is the ceiling-embedded air conditioning indoor unit of the fifteenth aspect of the invention, wherein the fan is a turbo fan whose outer edge as seen in a top view is placed on the inner side of the blow-out port.

In this ceiling-embedded air conditioning indoor unit, a turbo fan forms the air flow, and the outer edge of the turbo fan as seen in a top view is placed on the inner side of the blow-out port. For this reason, a radial direction component can be created in the traveling direction of the air flow by the turbo fan. Moreover, the air flow having the radial direction component passes through the blow-out port that is placed further outward, whereby the air flow can be provided to the air conditioning target space while the radial direction component is maintained or increased. In this way, the draft sensation imparted to the user existing in the air conditioning target space can be reduced because the radial direction component is included in the air flow direction, and it becomes possible to keep the ventilation resistance small compared to a case where the placement shape or the like of the blow-out port is utilized to abruptly bend the traveling direction of the air flow because the blow-out port and the turbo fan can cooperate to direct the traveling direction of the air flow gradually in the radial direction.

A ceiling-embedded air conditioning indoor unit of a seventeenth aspect of the invention is the ceiling-embedded air conditioning indoor unit of any of the first to sixteenth aspects of the invention, further comprising a filter that is placed between the suction port and the heat exchanger. The indoor unit casing has a filter up-and-down accommodation opening for inserting and removing the filter by sliding the filter up and down and a filter cover that covers the filter up-and-down accommodation opening.

In this ceiling-embedded air conditioning indoor unit, a short cut by the conditioned air through the filter up-and-down accommodation opening can be prevented because the filter up-and-down accommodation opening can be closed by the filter cover.

A ceiling-embedded air conditioning indoor unit of an eighteenth aspect of the invention is the ceiling-embedded air conditioning indoor unit of any of the first to sixteenth aspects of the invention, further comprising a filter that is placed between the suction port and the heat exchanger. The indoor unit casing has a filter horizontal accommodation opening for inserting and removing the filter by sliding the filter in a substantially horizontal direction.

In this ceiling-embedded air conditioning indoor unit, the position of the blow-out port and the position of the filter can be placed on top of each other in the vertical direction because the filter can be inserted and removed by sliding the filter up and down. Further, an increase in the size of the indoor unit on a horizontal plane can be suppressed.

A ceiling-embedded air conditioning indoor unit of a nineteenth aspect of the invention is the ceiling-embedded air conditioning indoor unit of any of the first to sixteenth aspects of the invention, further comprising two or more filters. The two or more filters are placed between the suction port and the heat exchanger and in positions configuring at least any two sides of four sides of a substantially quadrilateral shape as seen in a top view. The undersurface of the indoor unit casing has shape symmetry as seen in a bottom view by having filter up-and-down accommodation openings, filter covers, an opening, and a cover. The filter up-and-down accommodation openings are disposed below the two or more filters such that the filters become capable of being inserted and removed by sliding the filters up and down. The filter covers cover the filter up-and-down accommodation openings. The opening is disposed below a portion configuring a side of the four sides of the substantially quadrangular shape on which the filters are not disposed and which is of a size substantially equal to the filter up-and-down accommodation openings. The cover covers the opening and is of a size substantially equal to the filter covers. The shape of the undersurface of the indoor unit casing does not have to be related to the placement of the filter up-and-down accommodation openings, the filter covers, the opening, and the cover and may, for example, be a substantially polygonal shape or a substantially circular shape. Further, it is preferable for the undersurface of the indoor unit casing to be independent as one part or to be removable.

In this ceiling-embedded air conditioning indoor unit, there is no longer the need to be aware of directionality when installing the undersurface of the indoor unit casing because in the undersurface of the indoor unit casing there is shape symmetry in the placement of the filter up-and-down accommodation openings, the filter covers, the opening, and the cover, and installation workability can be improved.

A ceiling-embedded air conditioning indoor unit of a twentieth aspect of the invention is the ceiling-embedded air conditioning indoor unit of any of the first to nineteenth aspects of the invention, wherein the heat exchanger is placed so as to surround the radial direction outer side of the fan with respect to the axis of rotation of the fan. The width of the heat exchanger in the radial direction with respect to the axis of rotation of the fan is shorter than the width of the heat exchanger in the vertical direction.

In this ceiling-embedded air conditioning indoor unit, by ensuring that the width of the heat exchanger in the radial direction with respect to the axial direction of the fan becomes shorter than the width of the heat exchanger in the vertical direction, it becomes possible to miniaturize the shape of the indoor unit as seen in a plan view by making its width in the radial direction thin while ensuring its capacity by making its width in the vertical direction long even in a case where its width in the radial direction has been made thin.

Advantageous Effects of the Invention

In the ceiling-embedded air conditioning indoor unit of the first aspect of the invention, it becomes possible to easily install the indoor unit with respect to a desired frame while miniaturizing the indoor unit to become an indoor unit where the length of one side is equal to or less than 600 mm while suppressing the occurrence of a short circuit.

In the ceiling-embedded air conditioning indoor unit of the second aspect of the invention, the positioning and installation stability of the indoor unit casing can be improved.

In the ceiling-embedded air conditioning indoor unit of the third aspect of the invention, the sizes of the surfaces configuring the suction port can be made the same, and it becomes possible to suppress differences in suction and to perform uniform air conditioning.

In the ceiling-embedded air conditioning indoor unit of the fourth aspect of the invention, it becomes possible to easily install the indoor unit just by cutting away, into a shape corresponding to the outer edge shape of the undersurface of the indoor unit casing, the ceiling panel in which the indoor unit casing is to be installed.

In the ceiling-embedded air conditioning indoor unit of the fifth aspect of the invention, it becomes possible to make it easier for the edge of the cutaway portion of the ceiling panel and the outer edge of the undersurface member of the indoor unit casing to correspond to each other at the time of installation.

In the ceiling-embedded air conditioning indoor unit of the sixth aspect of the invention, it becomes easier to ensure, on the non-suction side surface side, working space that becomes necessary at the time of maintenance.

In the ceiling-embedded air conditioning indoor unit of the seventh aspect of the invention, access to the inside of the indoor unit casing via the access port becomes even easier.

In the ceiling-embedded air conditioning indoor unit of the eighth aspect of the invention, the heat exchange efficiency can be improved.

In the ceiling-embedded air conditioning indoor unit of the ninth aspect of the invention, it is difficult for the heat transfer pipe to become resistance to the air flow formed by the fan and an increase in the ventilation resistance can be kept small.

In the ceiling-embedded air conditioning indoor unit of the tenth aspect of the invention, the installability of the indoor unit can be improved.

In the ceiling-embedded air conditioning indoor unit of the eleventh aspect of the invention, the installability of the indoor unit can be improved.

In the ceiling-embedded air conditioning indoor unit of the twelfth aspect of the invention, dew condensation forming on the side surface of the electrical component portion on the heat exchanger side can be suppressed, and the need to dispose a heat insulating material on the inner side of the side surface of the electrical component portion on the heat exchanger side can be eliminated.

In the ceiling-embedded air conditioning indoor unit of the thirteenth aspect of the invention, it becomes possible to access the parts and so forth without having to remove the heat exchanger.

In the ceiling-embedded air conditioning indoor unit of the fourteenth aspect of the invention, the trouble of changing the access direction with each maintenance target can be saved.

In the ceiling-embedded air conditioning indoor unit of the fifteenth aspect of the invention, it is easy to ensure the air volume even in a case where the indoor unit has been miniaturized.

In the ceiling-embedded air conditioning indoor unit of the sixteenth aspect of the invention, the draft sensation imparted to the user existing in the air conditioning target space can be reduced, and it becomes possible to keep the ventilation resistance small compared to a case where the placement shape or the like of the blow-out port is utilized to abruptly bend the traveling direction of the air flow.

In the ceiling-embedded air conditioning indoor unit of the seventeenth aspect of the invention, a short cut by the conditioned air through the filter up-and-down accommodation opening can be prevented.

In the ceiling-embedded air conditioning indoor unit of the eighteenth aspect of the invention, an increase in the size of the indoor unit on a horizontal plane can be suppressed.

In the ceiling-embedded air conditioning indoor unit of the nineteenth aspect of the invention, there is no longer the need to be aware of directionality when installing the undersurface of the indoor unit casing, and installation workability can be improved.

In the ceiling-embedded air conditioning indoor unit of the twentieth aspect of the invention, it becomes possible to miniaturize the shape of the indoor unit as seen in a plan view by making its width in the radial direction thin while ensuring its capacity.

DESCRIPTION OF THE EMBODIMENTS

<First Embodiment>

A ceiling-embedded air conditioning indoor unit 1 pertaining to an embodiment of the present invention will be described below with reference to the drawings.

(Ceiling-Embedded Air Conditioning Indoor Unit 1)

An air conditioning apparatus is configured as a result of the ceiling-embedded air conditioning indoor unit 1 being connected via refrigerant pipes to an outdoor unit installed outdoors, but illustration thereof is omitted here.

Figure 4:
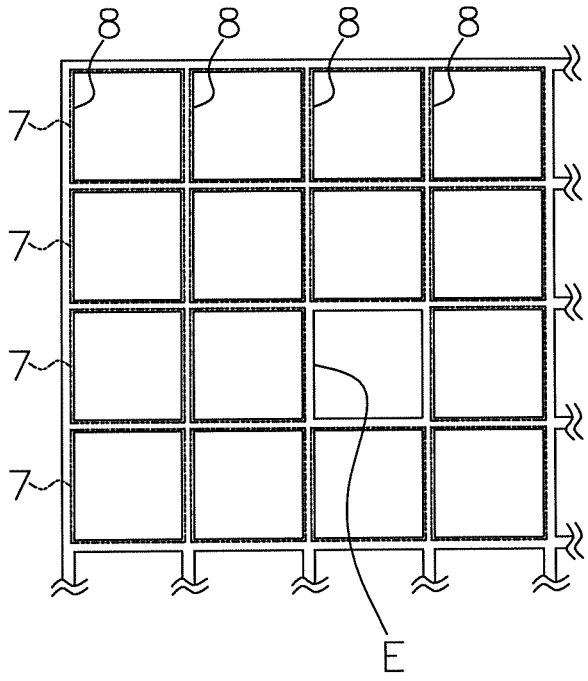
FIG. 4 is a configuration diagram of a ceiling in which the ceiling-embedded air conditioning indoor unit of the first embodiment is installed.

The ceiling-embedded air conditioning indoor unit 1 is installed in a grid-like ceiling such as shown in FIG. 4, sucks in and conditions the air on the ceiling backside, and supplies the conditioned air with respect to a room space below the ceiling.

Figure 1:
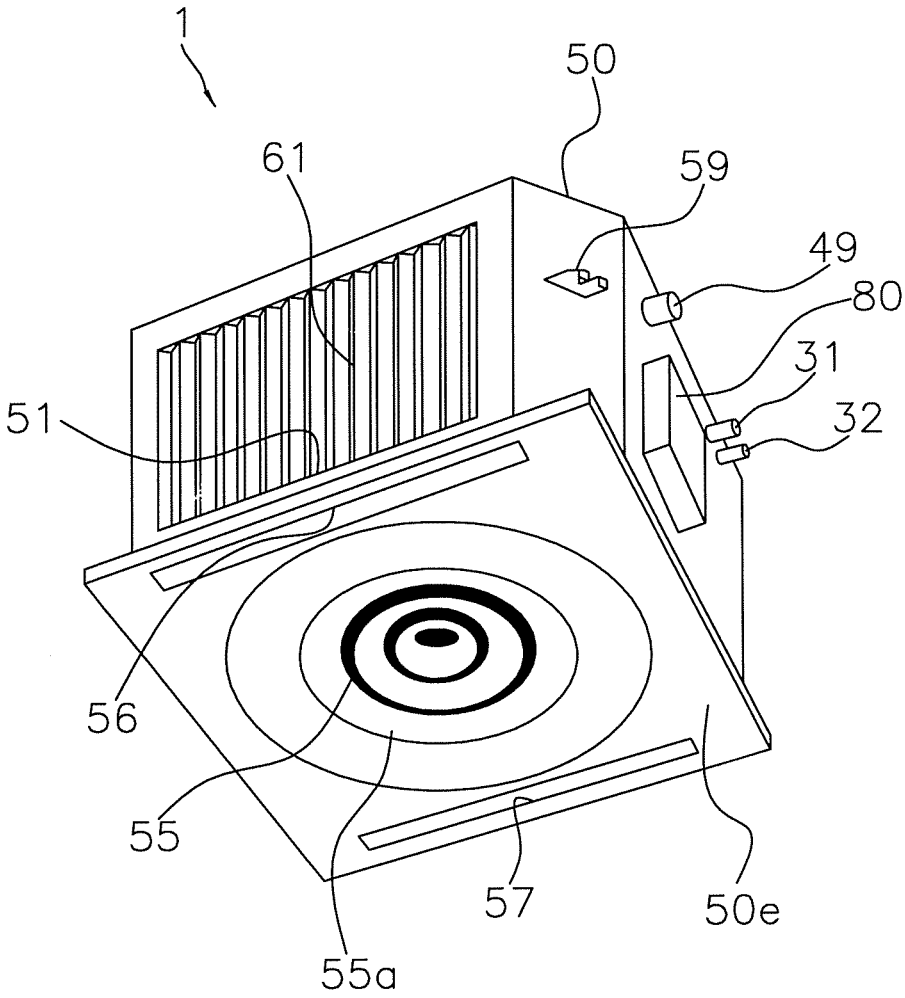
FIG. 1 is an external perspective view of a ceiling-embedded air conditioning indoor unit of a first embodiment.
Figure 2:
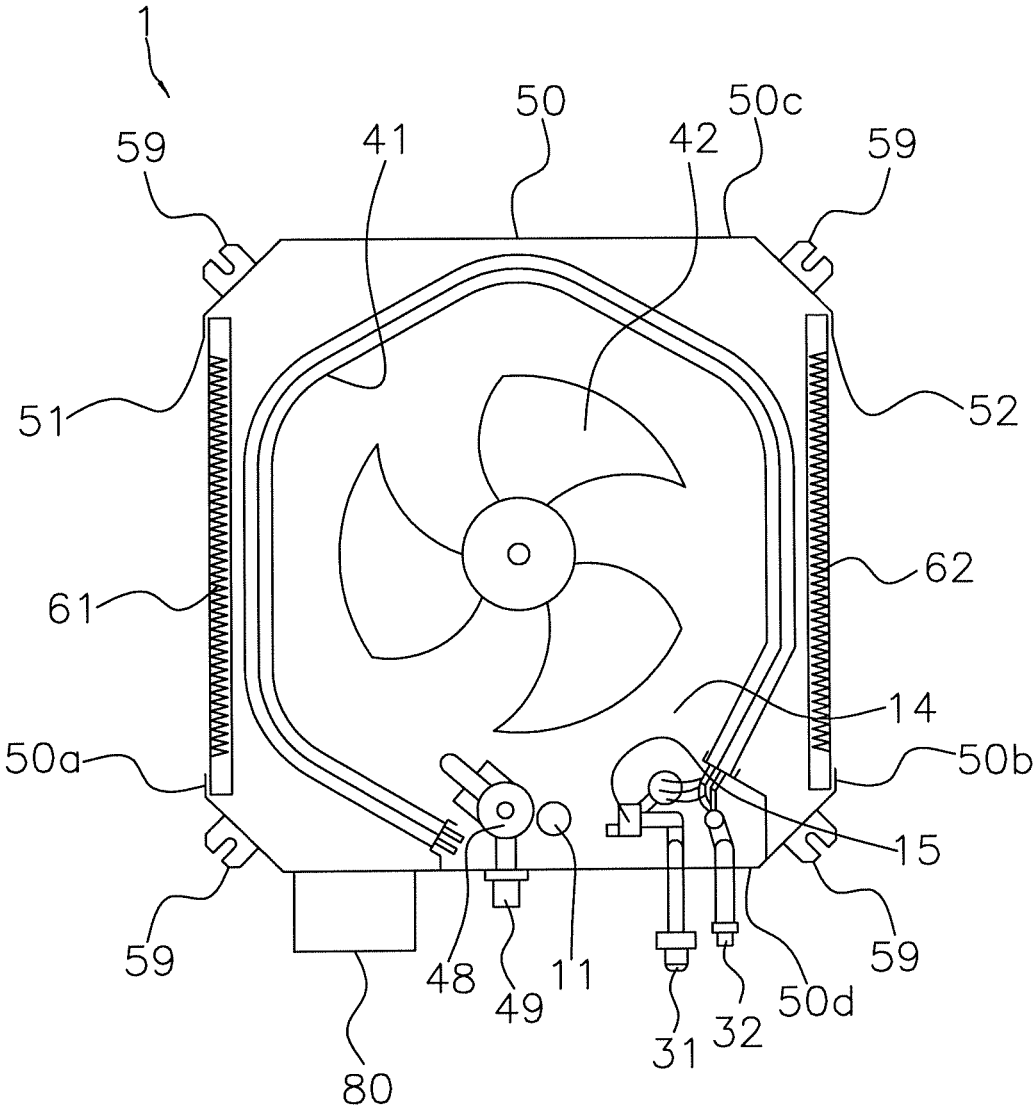
FIG. 2 is a plan sectional view of the ceiling-embedded air conditioning indoor unit of the first embodiment.
Figure 3:
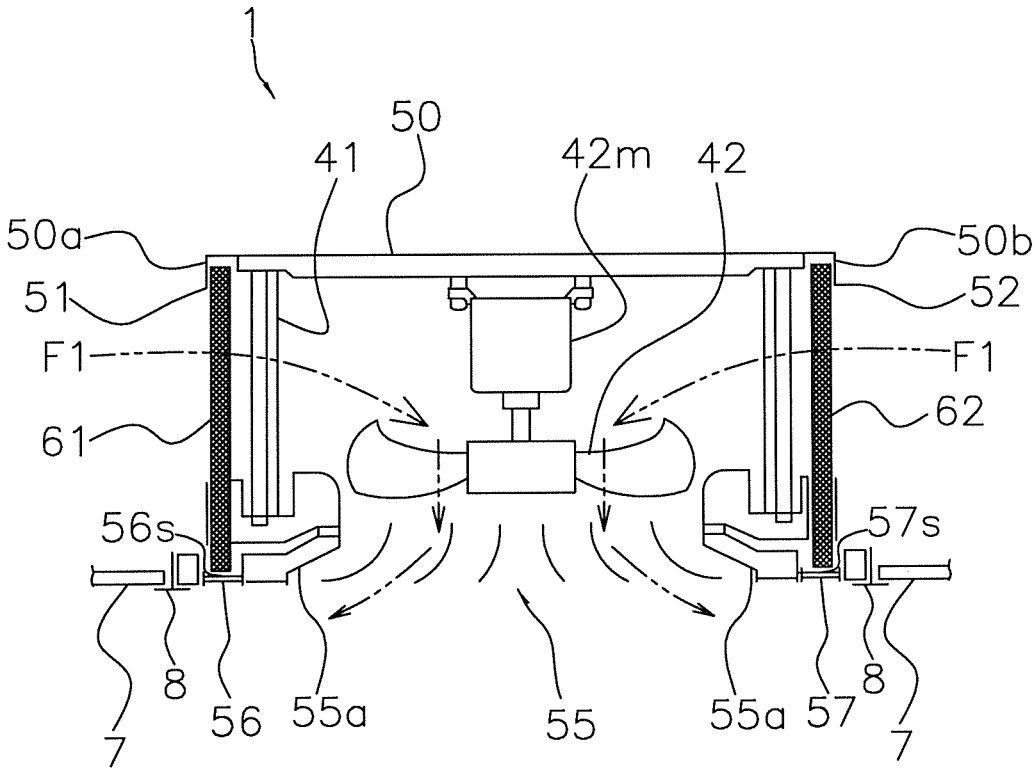
FIG. 3 is a side sectional view of the ceiling-embedded air conditioning indoor unit of the first embodiment.

As shown in the external perspective view in FIG. 1, the plan sectional view in FIG. 2, and the side sectional view in FIG. 3, this indoor unit 1 is equipped with a gas pipe 31, a liquid pipe 32, an indoor heat exchanger 41, an indoor fan 42, a drain pump 48, a drain pipe 49, an indoor unit casing 50, air filters 61 and 62, an electrical component box 80, a drain pan 14, a float switch 11, and an motor-driven valve 15 and so forth.

As shown in FIG. 4, the ceiling in which the indoor unit 1 is installed has ceiling frames 8 that extend grid-like and square ceiling panels 7 that are fixed with respect to the intervening spaces between the ceiling frames 8. Each of the ceiling panels 7 has an area that is slightly wider than the area of one of the ceiling frames 8, and each side of the four sides configuring its outer edge overlaps the ceiling frame 8 in the vertical direction and is fixed. The indoor unit 1 is installed so as to just fit into the portion of a void E, which is shown in FIG. 4 as a portion from which one of the ceiling panels 7 has been removed. The one void E configured by this ceiling frame 8 is a 600 mm×600 mm square.

The gas pipe 31 is connected to one end of a heat transfer pipe configuring the indoor heat exchanger 41, and the liquid pipe 32 is connected to the other end of the heat transfer pipe configuring the indoor heat exchanger 41. The gas pipe 31 and the liquid pipe 32 extend to the unillustrated outdoor unit.

The indoor unit casing 50 has a first side surface 50*a* in which a first suction port 51 for taking inside the air in the space on the ceiling backside is disposed, a second side surface 50*b* in which a second suction port 52 is disposed, a maintenance surface 50*d* for performing maintenance, a third side surface 50*c* that opposes the maintenance surface 50*d*, an undersurface 50*e* in which a blow-out port 55 for blowing out the conditioned air into the room is disposed, and hanging brackets 59 for fixing the indoor unit 1 to the ceiling backside in a hanging state. The first side surface 50*a* in which the first suction port 51 is disposed and the second side surface 50*b* in which the second suction port 52 is disposed are positioned so as to oppose each other. The undersurface 50*e* has substantially the same outer edge shape and size as those of the aforementioned one ceiling panel 7 and can be installed without deteriorating the design of the ceiling surface by replacing, with the undersurface 50*e* of the indoor unit casing 50 of the indoor unit 1, the ceiling panel 7 mounted in the portion of the ceiling in which the indoor unit 1 is to be installed. The undersurface 50*e* of the indoor unit casing 50 has a blow-out port configuring portion 55*a* that is placed around the blow-out port 55 to shape the blow-out port 55. Moreover, the undersurface 50*e* of the indoor unit casing 50 has, between its outer edge and the blow-out port configuring portion 55*a*, filter take-out openings 56*s* and 57*s* for taking out the later-described filters 61 and 62 and filter covers 56 and 57 that are disposed to close the filter take-out openings 56*s* and 57*s*. The hanging brackets 59 are formed so as to project outward at four places on outer sides of diagonal lines of the indoor unit casing 50.

The indoor fan 42 is a propeller fan placed inside the indoor unit casing 50 such that its axial direction substantially coincides with the vertical direction. The indoor fan 42 is rotated by the driving force from an indoor fan motor 42*m* placed above the indoor fan 42 in the vertical direction and forms air flows F1 in which the indoor fan 42 takes in the air on the ceiling backside via the suction ports 51 and 52 in the indoor unit casing 50 and blows out the air into the room via the blow-out port 55. By employing a propeller fan in this way, it becomes easy to ensure the air volume even in a case where the indoor unit 1 has been miniaturized.

The indoor heat exchanger 41 is placed substantially cylindrically on the inner side of the indoor unit casing 50 such that its axial direction coincides with the vertical direction and is positioned between the indoor fan 42 and the side surfaces of the indoor unit casing 50. The portions of the indoor heat exchanger 41 near the first side surface 50*a* and the second side surface 50*b* are placed so as to become parallel with respect to the first side surface 50*a* and the second side surface 50*b* and are continuous near the center of the third side surface 50*c*. The indoor heat exchanger 41 is placed such that its portion on the first side surface 50*a* side becomes closer to the first suction port 51 and its portion on the second side surface 50*b* side becomes closer to the second suction port 52 with increasing distance away from the third side surface 50*c*. Because of this, even in a case where the indoor unit casing 50 performs suction only at the two side surfaces of the first side surface 50*a* and the second side surface 50*b*, it becomes possible for the indoor heat exchanger 41 to perform heat exchange efficiently also in the portion near the third side surface 50*c* because it does not have much surface parallel to the third side surface 50*c* and it is placed slanted with respect to the third side surface 50*c*. Further, because the indoor heat exchanger 41 is placed such that its axial direction substantially coincides with the vertical direction, in a case where space can be ensured in the vertical direction even in the case of reducing the size of the indoor unit casing 50 in a horizontal plane, both a narrowing of the horizontal area and a preservation of capacity can be realized by employing an indoor unit casing of a size with which the capacity of the heat exchanger can be ensured.

The drain pan 14 is placed so as to cover the underside of the indoor heat exchanger 41.

The float switch 11 is placed on the upper side of the drain pan 14 and starts and stops the drive control of the drain pump 48 by grasping the water level of the condensed water that has accumulated in the drain pan 14.

The motor-driven valve 15 is placed inside the indoor unit casing 50 near the maintenance surface 50*d* side.

The drain pump 48 is a lift pump for pumping and discharging the dew condensation water that has formed on the surface of the indoor heat exchanger 41. The water that has been pumped by this drain pump 48 is drained via the drain pipe 49. Here, the dew condensation water that has formed on the surface of the indoor heat exchanger 41 is caught in the drain pan 14 outspread below the indoor heat exchanger 41. Because of this, the drain pump 48 can pump the dew condensation water that has been caught in the drain pan 14.

The air filters 61 and 62 perform purification of the air before the air on the ceiling backside is taken inside the indoor unit casing 50. The air filters 61 and 62 are inserted and removed substantially in the vertical direction via the filter take-out ports 56*s* and 57*s* for inserting and removing the air filters 61 and 62. Further, the filter take-out ports 56*s* and 57*s* can be closed by the filter covers 56 and 57, so the air filters 61 and 62 are fixed in positions where they can exhibit their filtering function during use. Further, because the filter covers 56 and 57 are placed near the blow-out port 55 in this way, the fear that a short cut by the conditioned air through the filter take-out ports 56*s* and 57*s* will arise can be reduced.

The electrical component box 80 is mounted on the maintenance surface 50*d* side of the indoor unit casing 50 and performs control of each configural part of the indoor unit 1.

The gas pipe 31, the liquid pipe 32, the drain pipe 49, and the electrical component box 80 are placed such that they are all gathered together on the maintenance surface 50*d* side of the indoor unit casing 50. For this reason, in the case of performing maintenance on any of the gas pipe 31, the liquid pipe 32, the drain pipe 49, and the electrical component box 80 after having installed the indoor unit 1 with respect to the ceiling surface, the person performing the maintenance can reach any of the parts and perform maintenance on them without having to change the access direction by accessing them from the same direction. Further, near the maintenance surface 50*d*, factors that inhibit the heat exchange capacity can be reduced because the effective area of the indoor heat exchanger 41 is small, and the ventilation resistance can be kept small because these members are not placed in the areas are near the first side surface 50*a*, the second side surface 50*b*, and the third side surface 50*c* where the heat exchange efficiency is excellent.

(Installation of Indoor Unit 1)

Figure 5:
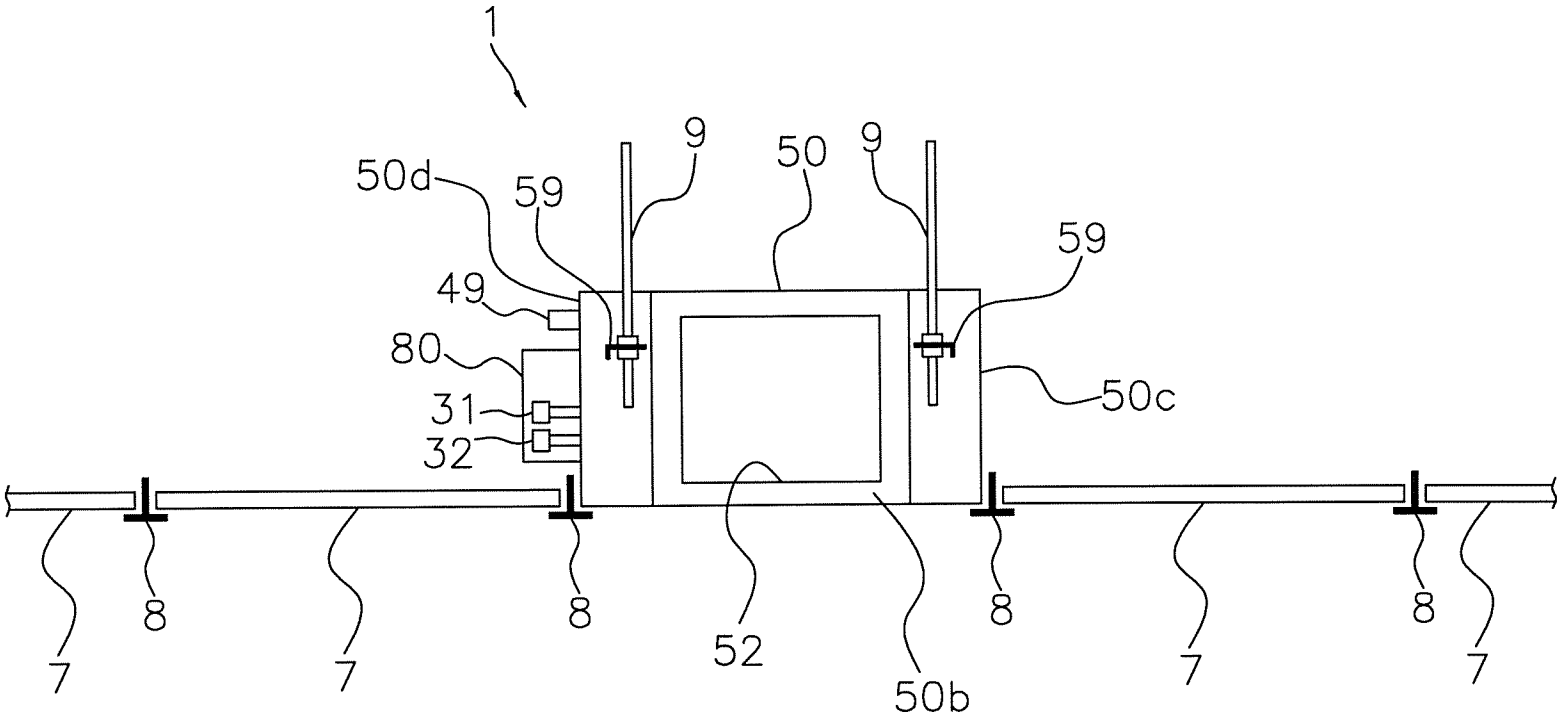
FIG. 5 is a side view showing an installed state of the ceiling-embedded air conditioning indoor unit of the first embodiment.
Figure 6:
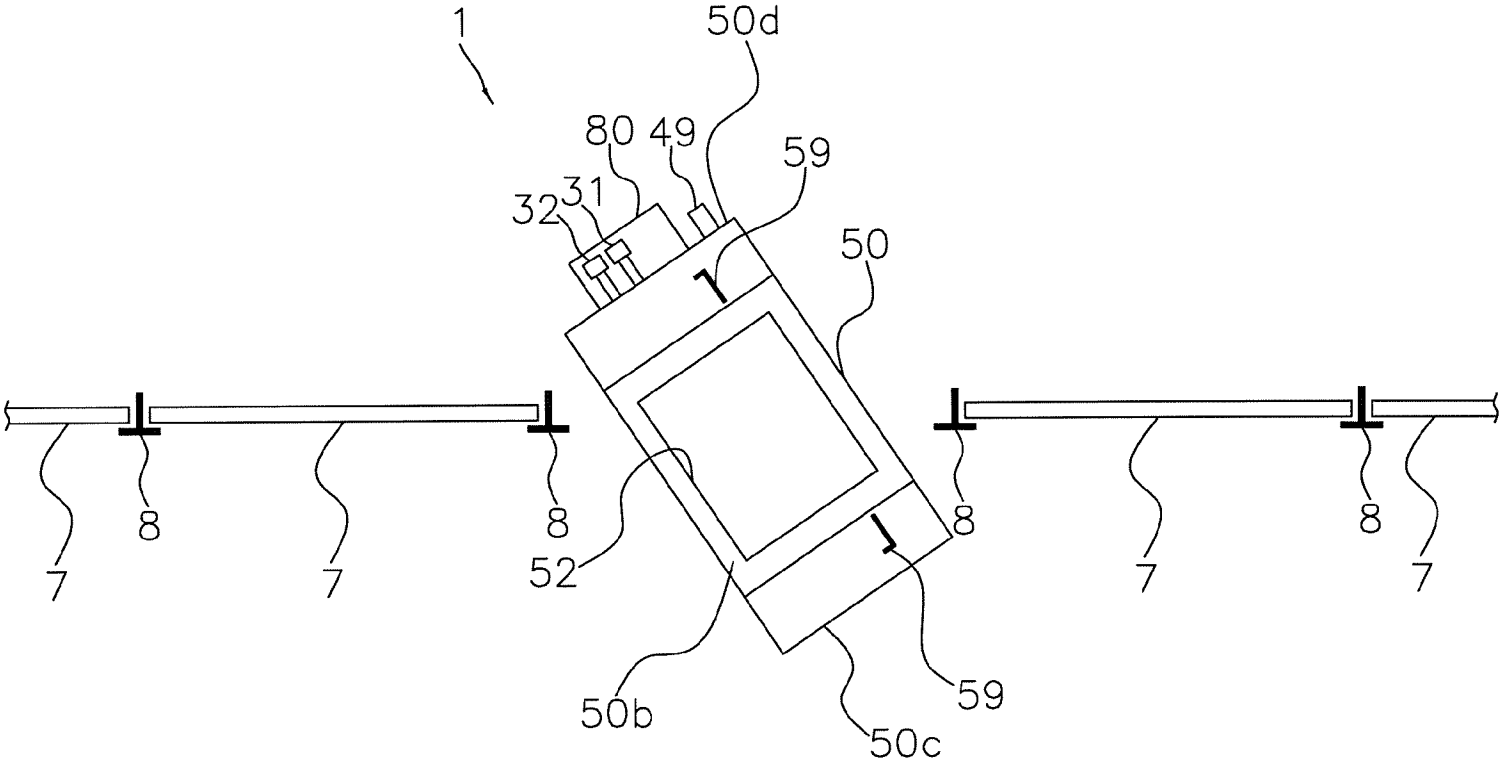
FIG. 6 is a side view showing a state midway during installation of the ceiling-embedded air conditioning indoor unit of the first embodiment.

As shown in FIG. 5 and FIG. 6, the indoor unit 1 is installed by removing one of the ceiling panels 7 among the frames 8 and the ceiling panels 7 configuring the ceiling to create an installation space for the indoor unit 1.

In this way, in the case of placing the indoor unit 1 in the void E shown in FIG. 4, first it is necessary to bring the indoor unit 1 from the underside of the ceiling to the ceiling backside as shown in FIG. 6. In this case, the indoor unit 1 passes through the void E, by passing the indoor unit 1 through the void E such that the side on which the electrical component box 80, the gas pipe 31, the liquid pipe 32, and the drain pipe 49 that extend in the lengthwise direction as seen in a plan view as mentioned above are disposed or the side opposing this side goes in first, it can be made easier for the indoor unit 1 to pass through the void E even in a case where the size of the indoor unit 1 is large.

The indoor unit 1 is installed by fixing four hanging rods 9 to the four hanging brackets 59 in a state where the outer edge of the undersurface 50*e* of the indoor unit casing 50 has been placed on the inner side of the frame 8. The outer edge of the undersurface 50*e* of the indoor unit casing 50 and the inner side of the frame 8 have shapes that fit together such that there is no intervening gap.

(Insertion and Removal of Air Filters 61 and 62)

Figure 7:
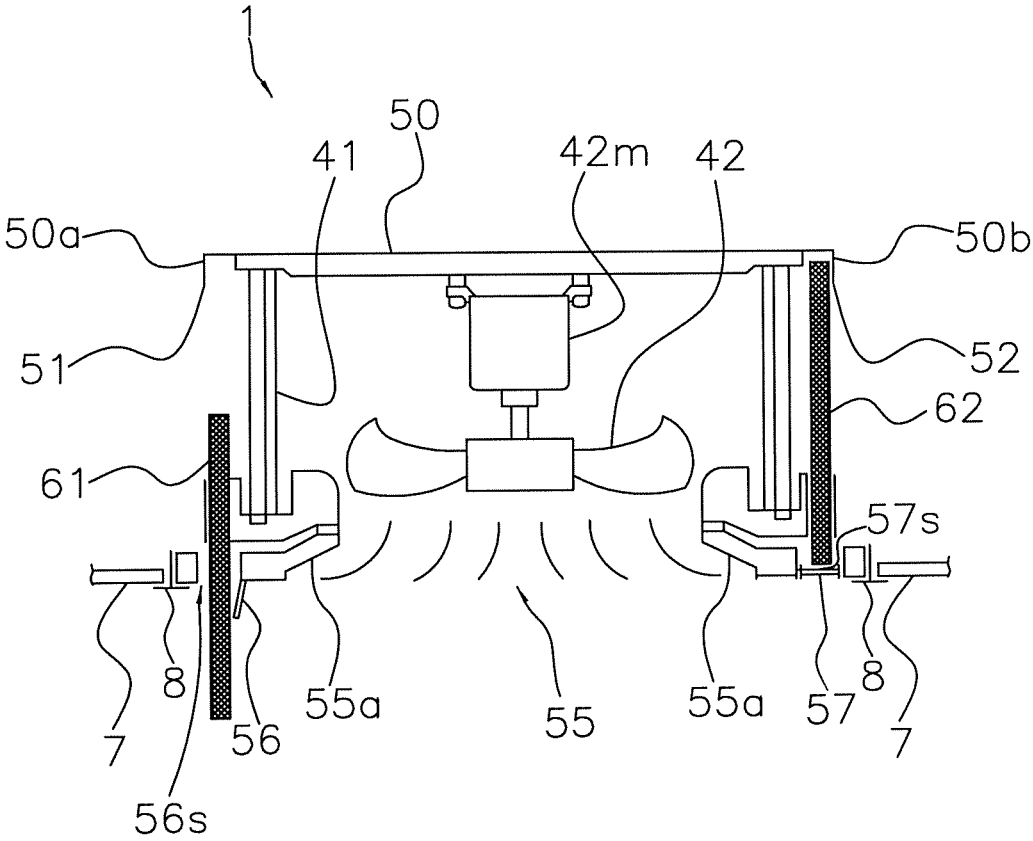
FIG. 7 is a view showing a filter replacement structure of the ceiling-embedded air conditioning indoor unit of the first embodiment.

As shown in FIG. 7, the air filters 61 and 62 can be inserted and removed by opening the filter take-out ports 56*s* and 57*s* and sliding the air filters 61 and 62 in the vertical direction via the filter take-out ports 56*s* and 57*s*.

Because of this, maintenance work such as replacing or cleaning the air filters 61 and 62 can be easily performed without having to go around to the ceiling backside.

<Characteristics of Ceiling-Embedded Air Conditioning Apparatus 1 of First Embodiment>

Figure 24:
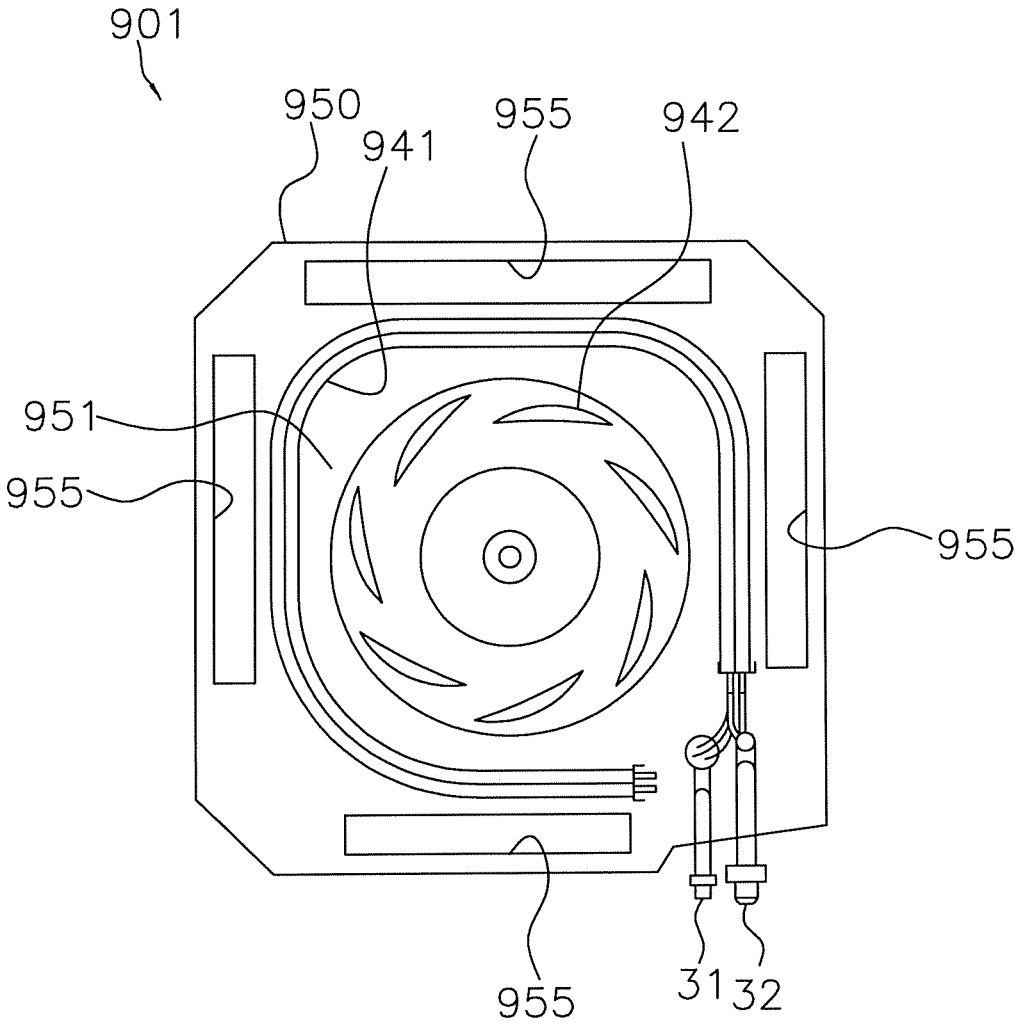
FIG. 24 is a plan sectional view of a conventional ceiling-embedded air conditioning indoor unit.
Figure 25:
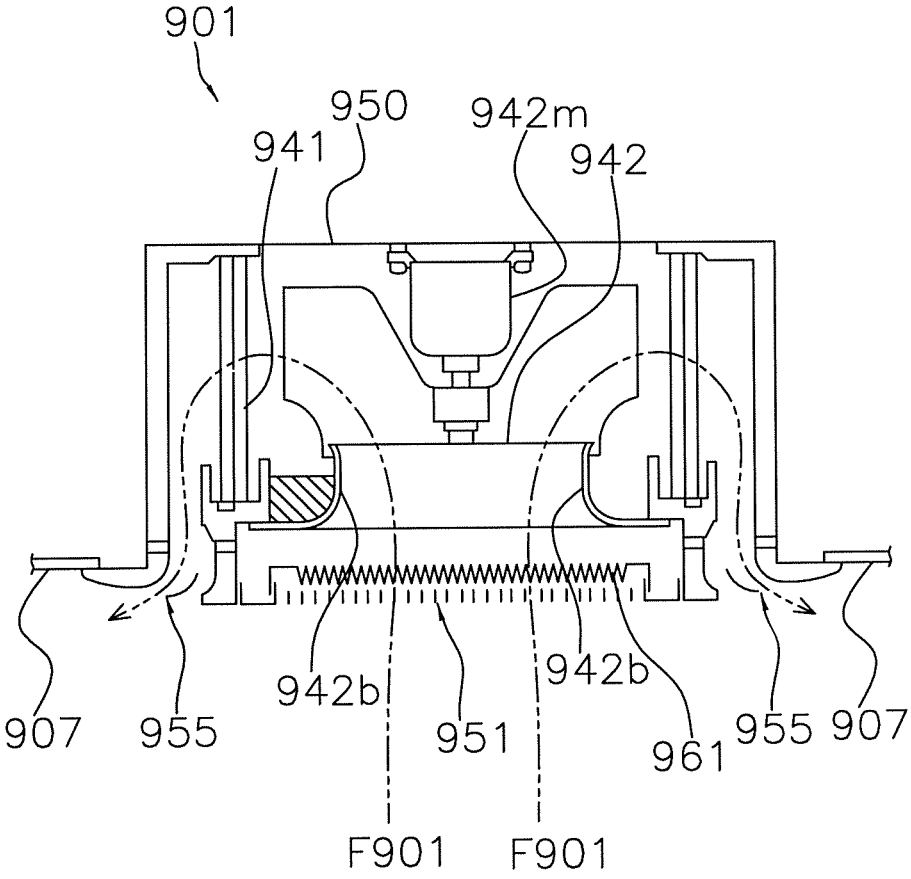
FIG. 25 is a side sectional view of the conventional ceiling-embedded air conditioning indoor unit.

Using FIG. 24 and FIG. 25, a conventional indoor unit 901 will be taken as an example and described in order to show a contrast with the ceiling-embedded air conditioning indoor unit 1 of the first embodiment.

The conventional indoor unit 901 is installed in a ceiling and is configured to suck in room air from a suction port 951 disposed near the center of an undersurface of the indoor unit 901 and return conditioned air to the room from four blow-out ports 955 disposed near the outer edge of the undersurface. These air flows F901 are, like in the first embodiment, produced as a result of an indoor fan 942 placed above a bell-mouth 942*b* being caused to rotate by the driving force of an indoor fan motor 942*m*. Further, an indoor heat exchanger 941 is placed so as to pass near the inner sides of the four blow-out ports 955.

In contrast, in the ceiling-embedded air conditioning indoor unit 1 of the first embodiment, the suction ports 51 and 52 and the blow-out port 55 are not in the same surface, so the size of the indoor unit 1 can be miniaturized compared to the conventional indoor unit 901 where the blow-out ports 955 have been disposed around, and in the same surface as, the suction port 951. Moreover, even in the case of miniaturizing the indoor unit 1 in this way, the air that has been blown out into the room from the blow-out port 55 is not immediately sucked back in from the suction ports 51 and 52 and can be retained in the conditioning target space because the ceiling frames 8 and the ceiling panels 7 configuring the ceiling intervene between the suction ports 51 and 52 and the blow-out port 55 disposed in the indoor unit casing 50. Because of this, the indoor unit 1 can be miniaturized while the occurrence of a short circuit is suppressed.

Further, because the indoor unit casing 50 of the indoor unit 1 has a square shape as seen in a plan view, the sizes of the surfaces 50*a* and 50*b* configuring the suction ports 51 and 52 can be made the same, differences in suction can be suppressed, and uniform air conditioning can be performed.

<Modifications of First Embodiment>

The first embodiment of the present invention has been described above on the basis of the drawings, but the specific configurations thereof are not limited to this and can be changed without departing from the gist of the invention.

(A)

In the first embodiment, a case where the undersurface 50*e* of the indoor unit casing 50 and the ceiling panel 7 had corresponding shapes and sizes was taken as an example and described.

However, the present invention is not limited to this.

Figure 8:
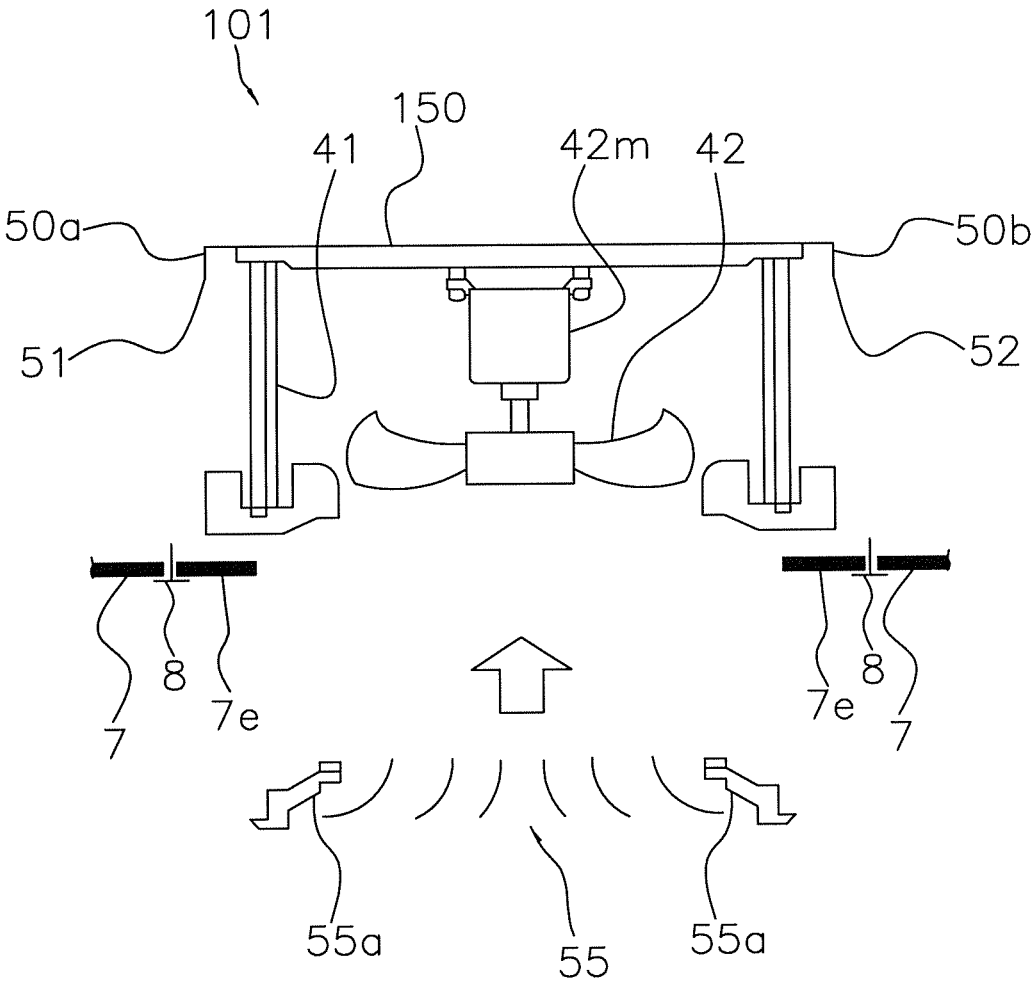
FIG. 8 is a side exploded sectional view of a ceiling-embedded air conditioning indoor unit of modification (A) of the first embodiment.
Figure 9:
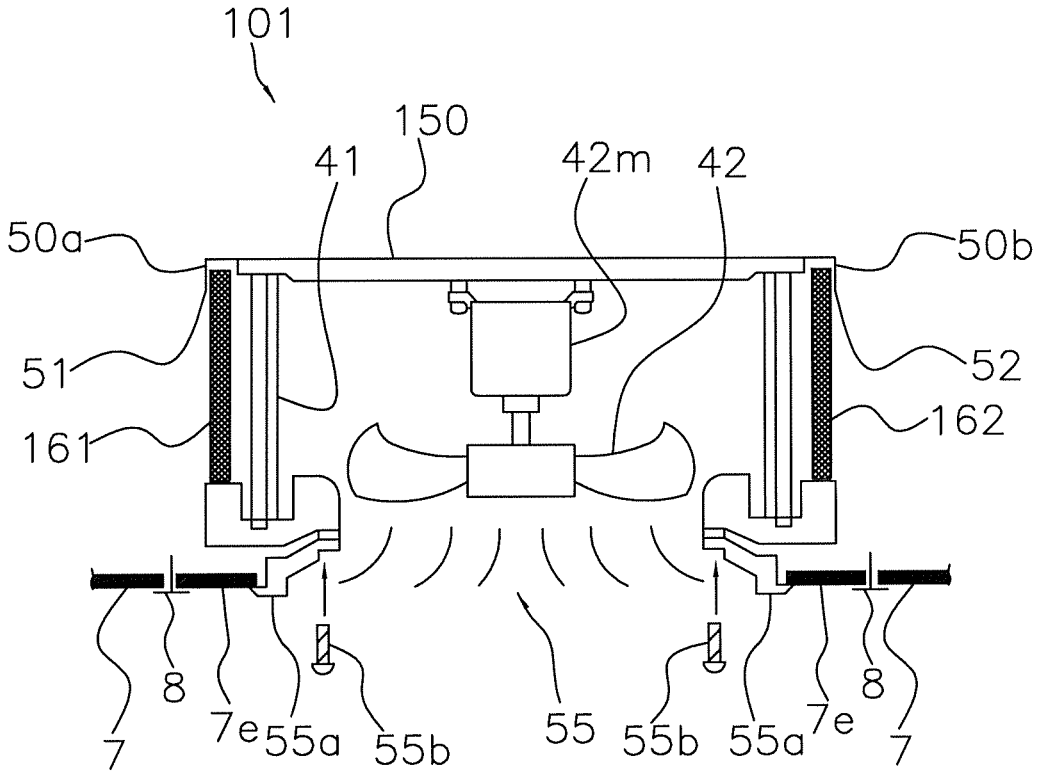
FIG. 9 is a side sectional view of the ceiling-embedded air conditioning indoor unit of modification (A) of the first embodiment.

For example, as shown in FIG. 8 and FIG. 9, the invention may also be applied to a case where the shape and size of an undersurface of an indoor unit casing 150 do not correspond to the shape and size of the ceiling panel 7. As a method of installing an indoor unit 101 having this indoor unit casing 150, for example, as shown in FIG. 8 and FIG. 9, one ceiling panel 7 may be cut beforehand so as to correspond to the shape and size of the undersurface of the indoor unit casing 250, and thereafter the indoor unit 101 may be installed such that the cut portion of the ceiling panel 7 is held in the vertical direction between the blow-out port configuring portion 55*a* and the remaining portion of the indoor unit casing 150. In this case, by forming a cutaway portion in the ceiling panel 7 at the time of installation, it can be made easier for the edge of the cutaway portion of the ceiling panel 7 and the outer edge of the blow-out port configuring portion 55*a* of the indoor unit casing 150 to correspond to each other, and it becomes possible to improve installability. By screwing together the blow-out port configuring portion 55*a* and the remaining portion of the indoor unit casing 150 with screws 55*b*, the fixing structure can be made stronger.

(B)

In the first embodiment, the indoor unit casing 50, in which the filter covers 56 and 57 and the filter take-out ports 56*s* and 57*s* were disposed in order to enable the air filters 61 and 62 to be inserted and removed in the vertical direction, was taken as an example and described.

However, the present invention is not limited to this.

Figure 10:
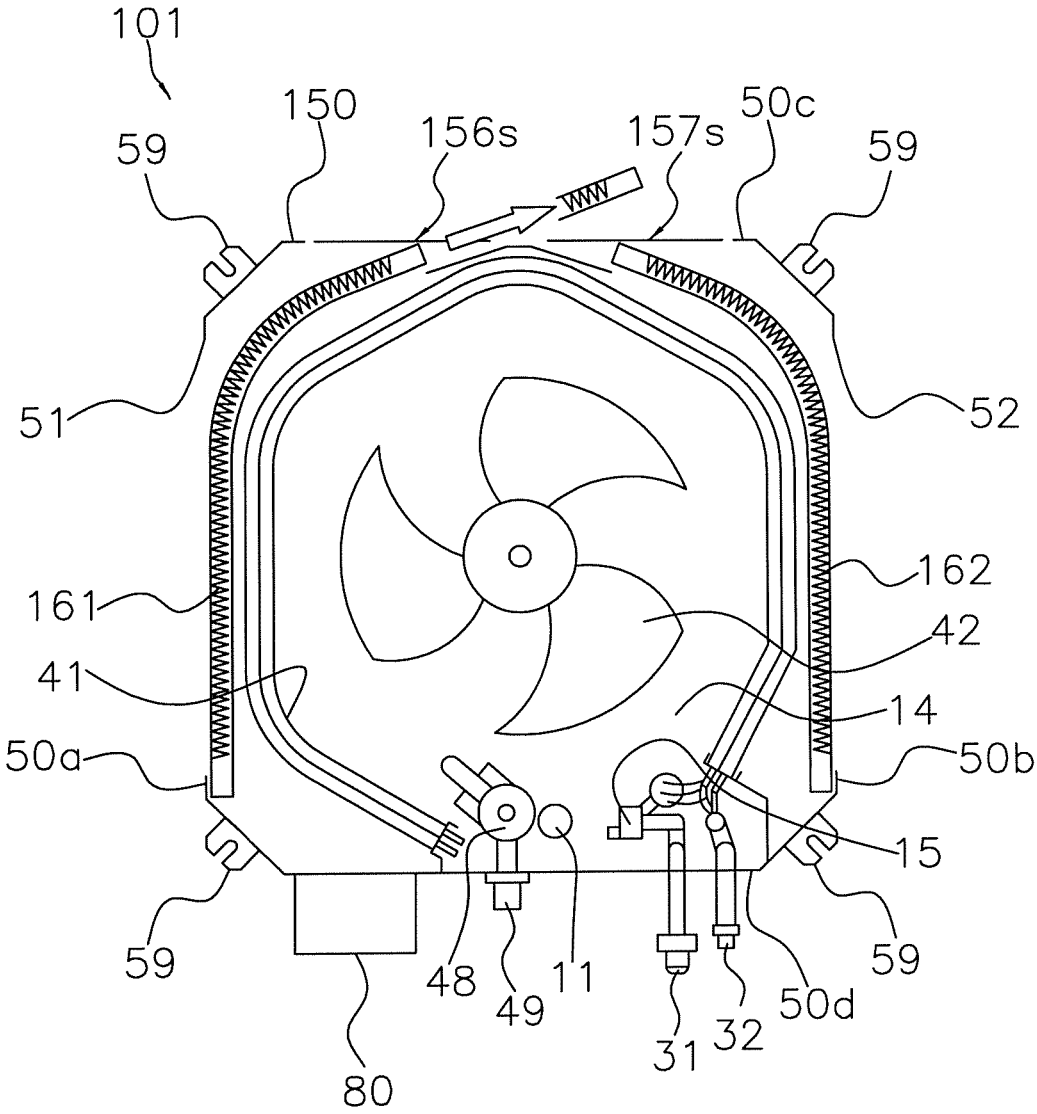
FIG. 10 is a plan sectional view of a ceiling-embedded air conditioning indoor unit of modification (B) of the first embodiment.

For example, as shown in FIG. 10, the invention may also be configured such that filter take-out ports 156*s* and 157*s* opening in the horizontal direction are disposed in the third side surface 50*c* of the indoor unit casing 150. In this case, maintenance of air filters 161 and 162 must be performed in the space on the ceiling backside, but it is not necessary to form the filter covers 56 and 57 in the undersurface 50*e* of the indoor unit casing 50 that is the room side like in the first embodiment, and the design can be improved.

Here, by employing a flexible material as the material of the air filters 161 and 162, the flexibility required at the time of inserting and removing the air filters 161 and 162 can be imparted as shown in FIG. 10. Moreover, the effective surface area of these air filters 161 and 162 may be given a wider area than the effective surface area of the air filters 61 and 62 of the first embodiment so as to more widely cover the indoor heat exchanger 41.

<Second Embodiment>

A ceiling-embedded air conditioning indoor unit 201 pertaining to another embodiment of the present invention will be described below with reference to the drawings.

Like in the first embodiment, in the second embodiment also, an air conditioning apparatus is configured as a result of the ceiling-embedded air conditioning indoor unit 201 being connected via refrigerant pipes to an outdoor unit installed outdoors. Additionally, the ceiling-embedded air conditioning indoor unit 201 is installed in a grid-like ceiling, sucks in and conditions the air on the ceiling backside, and supplies the conditioned air with respect to a room space below the ceiling.

(Ceiling-Embedded Air Conditioning Indoor Unit 201)

Figure 11:
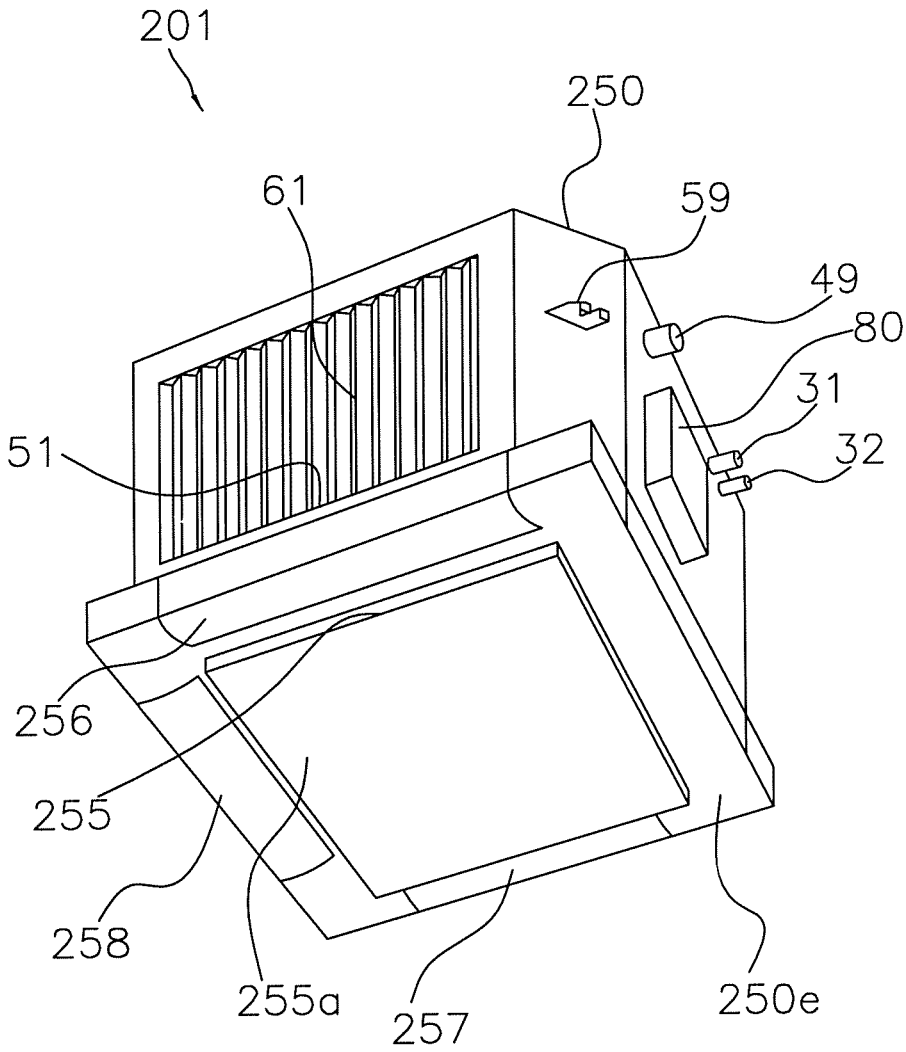
FIG. 11 is an external perspective view of a ceiling-embedded air conditioning indoor unit of a second embodiment.
Figure 12:
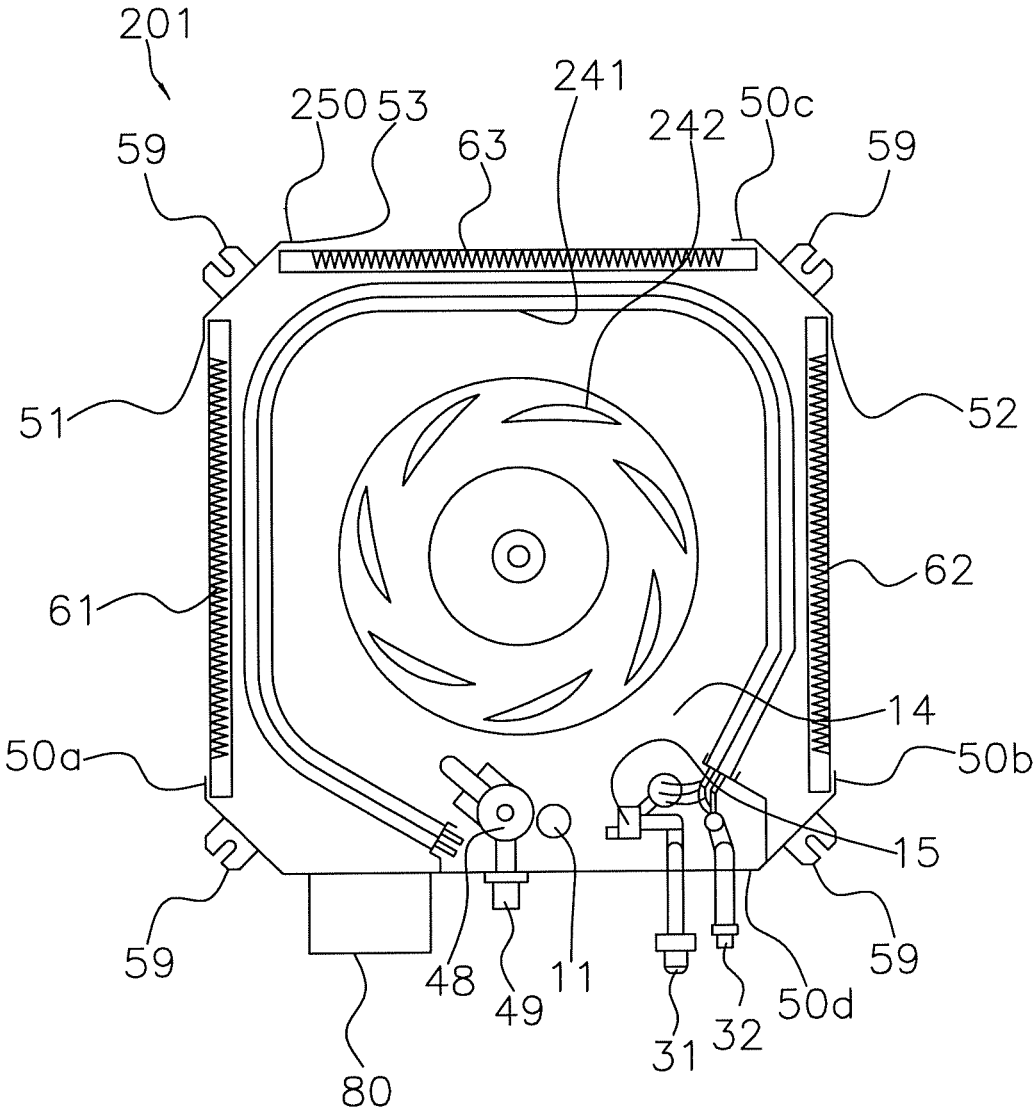
FIG. 12 is a plan sectional view of the ceiling-embedded air conditioning indoor unit of the second embodiment.
Figure 13:
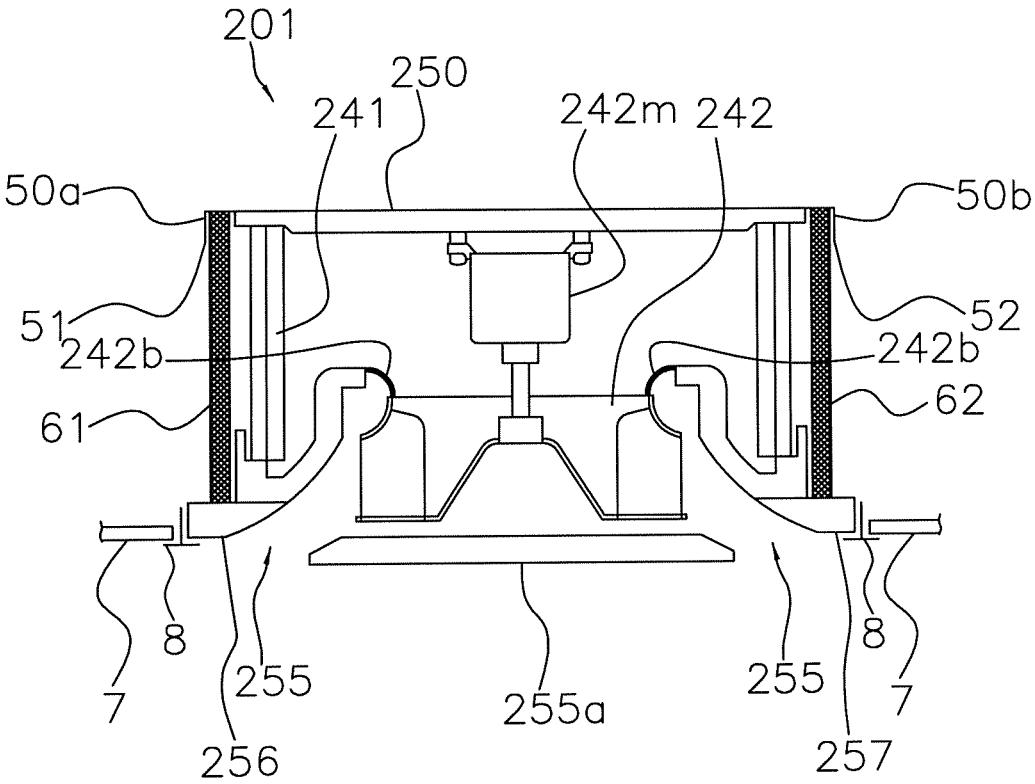
FIG. 13 is a side sectional view of the ceiling-embedded air conditioning indoor unit of the second embodiment.

As shown in the external perspective view in FIG. 11, the plan sectional view in FIG. 12, and the side sectional view in FIG. 13, the indoor unit 201 is equipped with a gas pipe 31, a liquid pipe 32, an indoor heat exchanger 241, an indoor fan 242, a drain pump 48, a drain pipe 49, an indoor unit casing 250, air filters 61, 62, and 63, and an electrical component box 80 and so forth.

The ceiling in which the indoor unit 201 is installed and the installation method are the same as those in the first embodiment. The gas pipe 31, the liquid pipe 32, the drain pump 48, the drain pipe 49, the air filters 61 and 62, the electrical component box 80, the drain pan 14, the float switch 11, and the motor-driven valve 15 are also the same as those in the first embodiment.

The indoor unit casing 250 has a first side surface 50*a* in which a first suction port 51 for taking inside the air in the space on the ceiling backside is disposed, a second side surface 50*b* in which a second suction port 52 is disposed, a third side surface 50*c* in which a third suction port 53 is disposed, a maintenance surface 50*d* for performing maintenance, an undersurface 250*e* in which a blow-out port 255 for blowing out the conditioned air into the room is disposed, and hanging brackets 59 for fixing the indoor unit 201 to the ceiling backside in a hanging state. The first side surface 50*a* in which the first suction port 51 is disposed and the second side surface 50*b* in which the second suction port 52 is disposed are positioned so as to oppose each other. The third side surface 30*c* and the maintenance surface 50*d* are positioned so as to oppose each other. The undersurface 250*e* has substantially the same outer edge shape and size as the outer edge shape and size of the one ceiling panel 7 mentioned in the first embodiment. This undersurface 250*e* can be easily installed without deteriorating the design of the ceiling surface by replacing, with the undersurface 250*e* of the indoor unit casing 250 of the indoor unit 201, the ceiling panel 7 mounted in the portion of the ceiling in which the indoor unit 201 is to be installed. The undersurface 250*e* of the indoor unit casing 250 has a blow-out port configuring panel 255*a*. This blow-out port configuring panel 255*a* is positioned on the inner side of the blow-out port 255 to shape the blow-out port 255 disposed around it and configures the edge on the inner side of the blow-out port 255. Moreover, the undersurface 250*e* of the indoor unit casing 250 has, so as to border its outer edge, filter covers 256, 257, and 258 for loading the air filters 61, 62, and 63. The hanging brackets 59 are formed so as to project outward at four places on outer sides of diagonal lines of the indoor unit casing 250.

The indoor fan 242 is a turbo fan placed inside the indoor unit casing 250 such that its axial direction substantially coincides with the vertical direction. The indoor fan 242 is rotated by the driving force from an indoor fan motor 242*m* placed above the indoor fan 242 in the vertical direction and forms air flows in which the indoor fan 242 takes in the air on the ceiling backside via the suction ports 51, 52, and 53 in the indoor unit casing 250 and blows out the air into the room via the blow-out port 255. By employing a turbo fan in this way, it becomes easy to ensure the air volume even in a case where the indoor unit 201 has been miniaturized.

The indoor heat exchanger 241 is placed substantially cylindrically on the inner side of the indoor unit casing 250 such that its axial direction coincides with the vertical direction and is positioned between the indoor fan 242 and the side surfaces of the indoor unit casing 250. The indoor heat exchanger 241 is placed such that its portions near the first side surface 50*a*, the second side surface 50*b*, and the third side surface 50*c* become parallel with respect to the first side surface 50*a*, the second side surface 50*b*, and the third side surface 50*c*.

(Insertion and Removal of Air Filters 61, 62, and 63)

Figure 14:
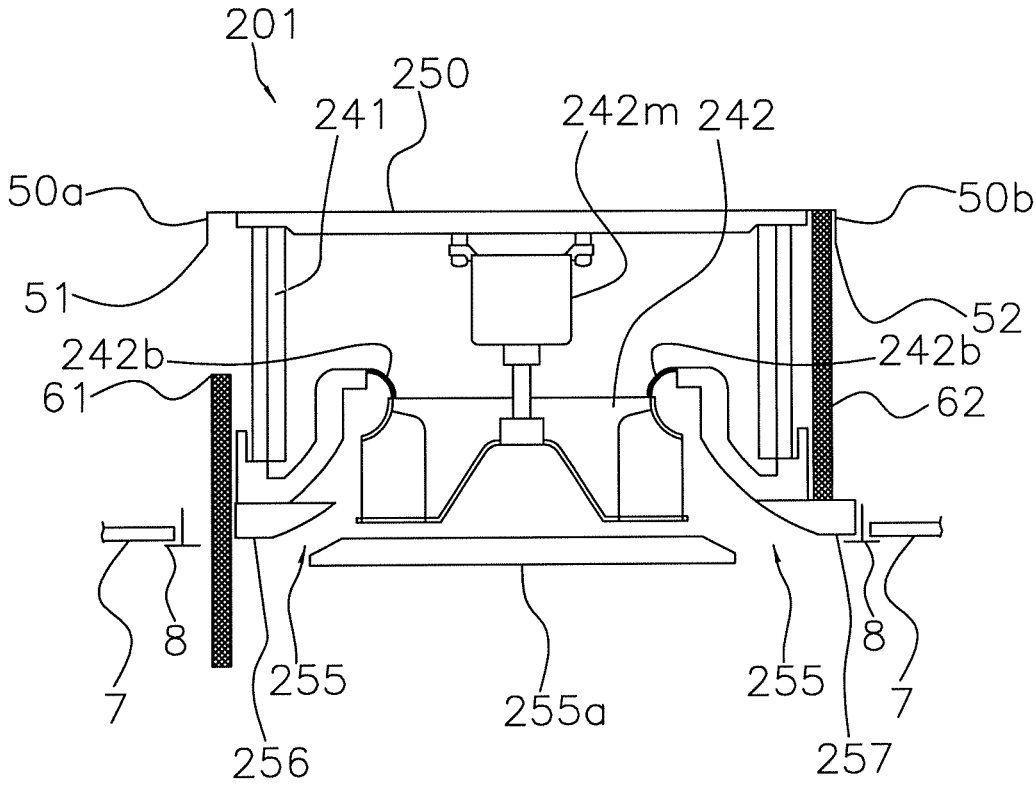
FIG. 14 is a view showing a filter replacement structure of the ceiling-embedded air conditioning indoor unit of the second embodiment.

As shown in FIG. 14, by sliding the filter covers 256, 257, and 258 in the horizontal direction so as to narrow the blow-out port 255, the air filters 61, 62, and 63 are released from being supported in the vertical direction and can be inserted and removed in the vertical direction. Because of this, maintenance such as replacing or cleaning the air filters 61, 62, and 63 can be easily performed without having to go around to the ceiling backside.

<Characteristics of Ceiling-Embedded Air Conditioning Apparatus 201 of Second Embodiment>

In the indoor unit 201 of the second embodiment, in order to maintain the air filters 61, 62, and 63 it suffices just to slide the filter covers 256, 257, and 258 in the horizontal direction so as to narrow the blow-out port 255, and the space of the blow-out port 255 with which the indoor unit 201 is equipped beforehand for blowing out the air can be effectively utilized. For this reason, it is not necessary to newly employ space or parts for maintaining the air filters 61, 62, and 63, so the indoor unit 201 in which replacement of the air filters 61, 62, and 63 is possible can be further miniaturized.

<Third Embodiment>

A ceiling-embedded air conditioning indoor unit 301 pertaining to still another embodiment of the present invention will be described below with reference to the drawings.

Like in the first embodiment, in the third embodiment also, an air conditioning apparatus is configured as a result of the ceiling-embedded air conditioning indoor unit 301 being connected via refrigerant pipes to an outdoor unit installed outdoors. Additionally, the ceiling-embedded air conditioning indoor unit 301 is installed in a grid-like ceiling, sucks in and conditions the air on the ceiling backside, and supplies the conditioned air with respect to a room space below the ceiling.

(Ceiling-Embedded Air Conditioning Indoor Unit 301)

Figure 15:
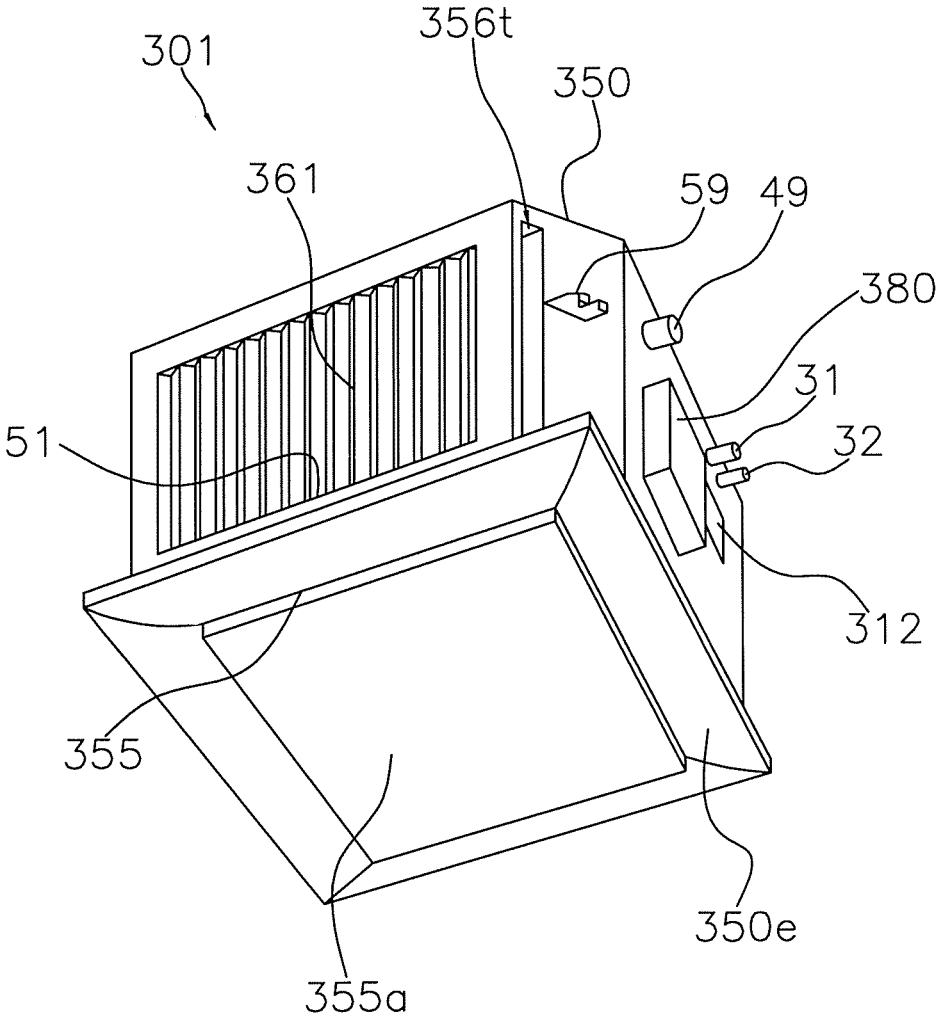
FIG. 15 is an external perspective view of a ceiling-embedded air conditioning indoor unit of a third embodiment.
Figure 16:
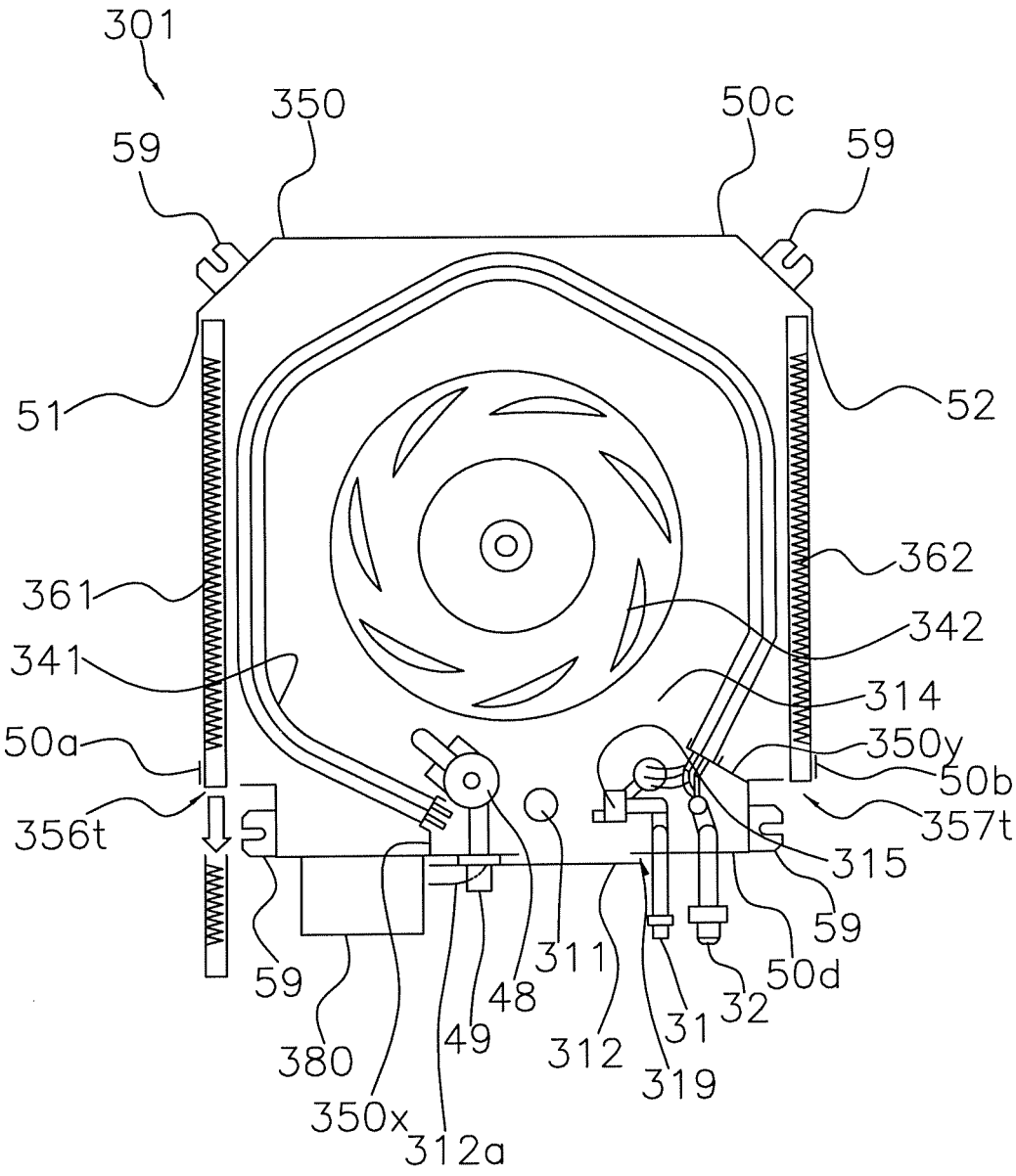
FIG. 16 is a plan sectional view of the ceiling-embedded air conditioning indoor unit of the third embodiment.
Figure 17:
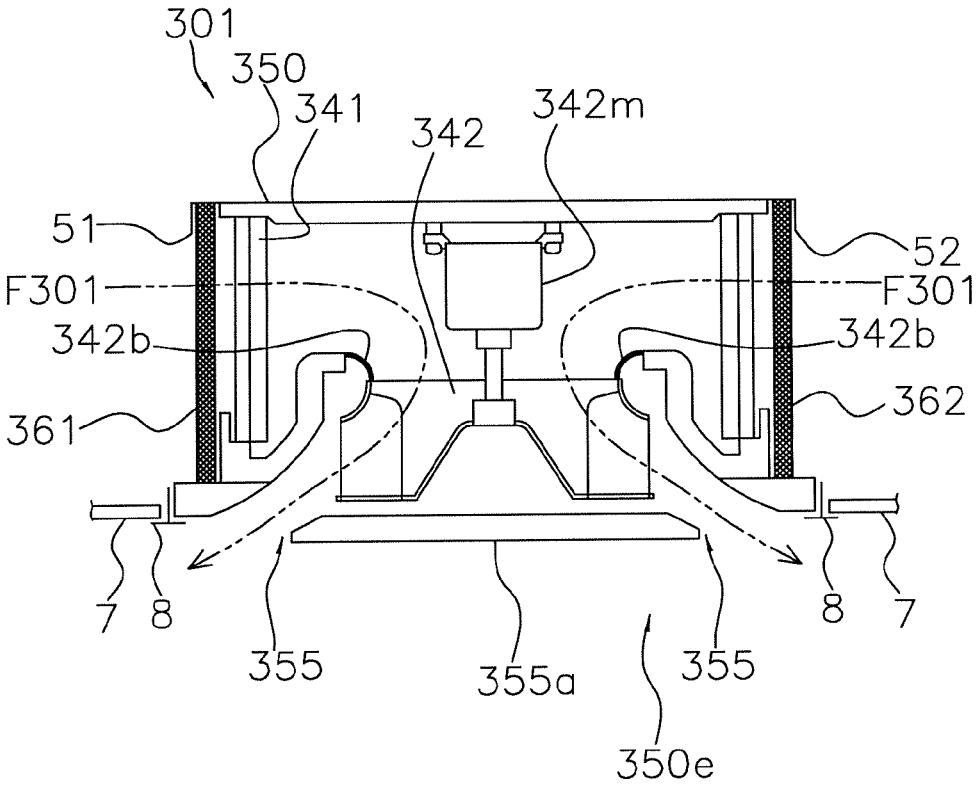
FIG. 17 is a schematic sectional view showing air flows in the ceiling-embedded air conditioning indoor unit of the third embodiment.
Figure 18:
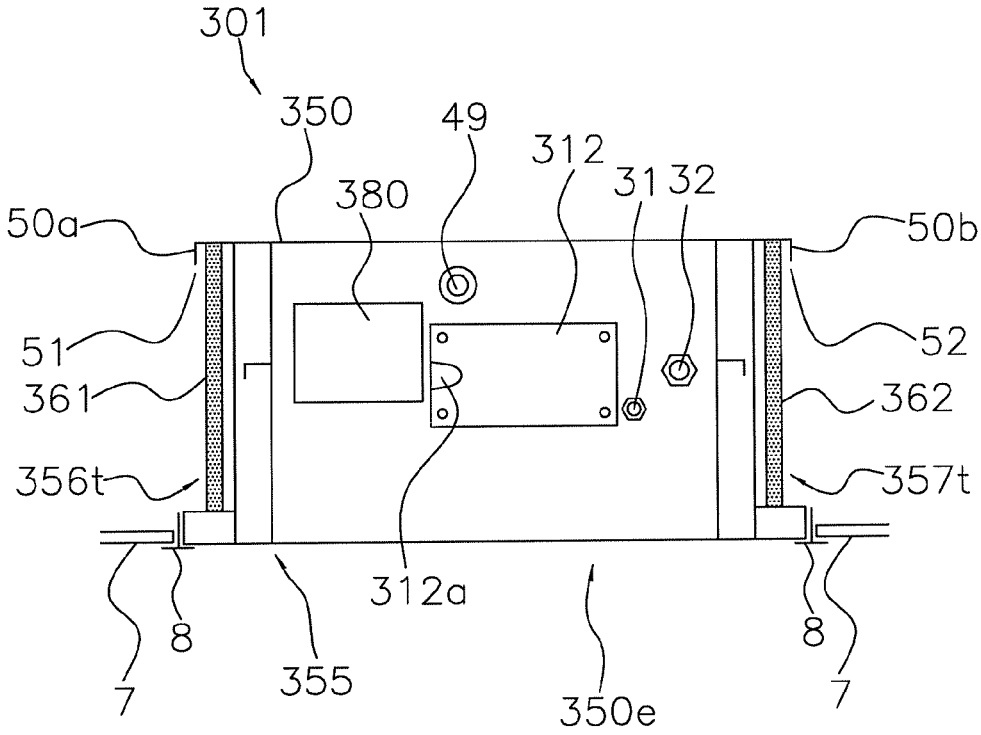
FIG. 18 is a side view of a maintenance surface side of the ceiling-embedded air conditioning indoor unit of the third embodiment.
Figure 19:
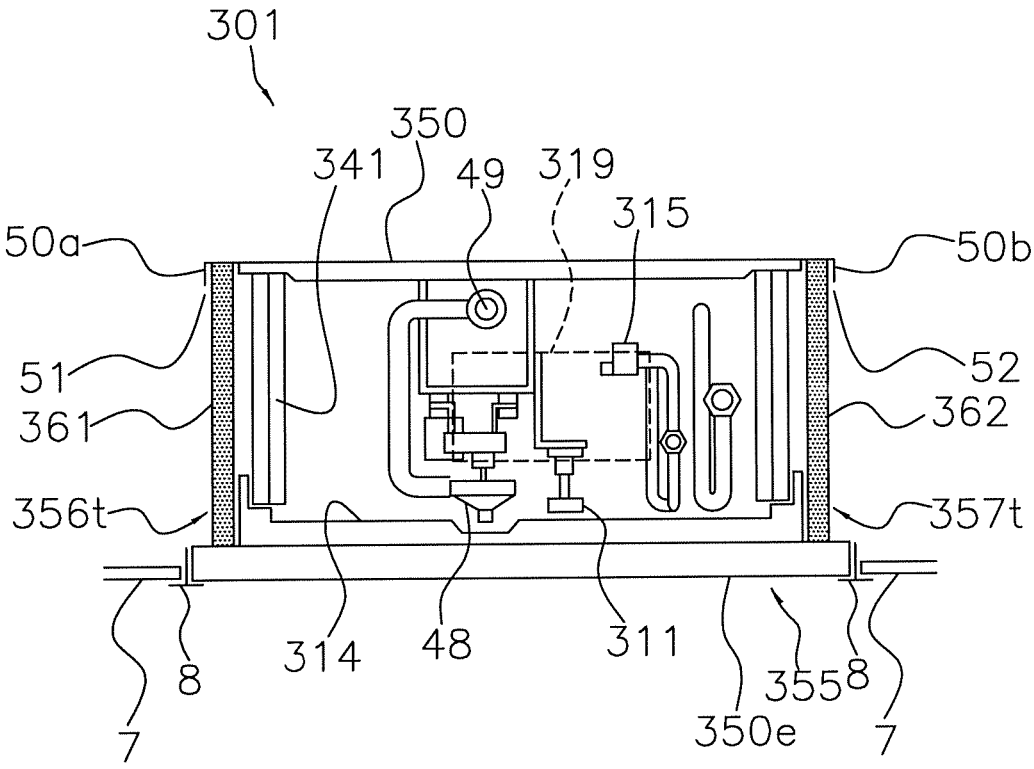
FIG. 19 is a placement configuration diagram of the inside of an indoor unit casing as seen from the maintenance surface side of the ceiling-embedded air conditioning indoor unit of the third embodiment.

As shown in the external perspective view in FIG. 15, the plan sectional view in FIG. 16, the plan sectional view showing air flows in FIG. 17, the side view of a maintenance surface side in FIG. 18, and the placement configuration diagram of the inside of an indoor unit casing as seen from the maintenance surface side in FIG. 19, the indoor unit 301 is equipped with a gas pipe 31, a liquid pipe 32, an indoor heat exchanger 341, an indoor fan 342, a drain pump 48, a drain pipe 49, an indoor unit casing 350, a motor-driven valve 315, a first air filter 361, a second air filter 362, an electrical component box 380, a drain pan 314, and a float switch 311 and so forth.

The ceiling in which the indoor unit 301 is installed and the installation method are the same as those in the first embodiment. The gas pipe 31, the liquid pipe 32, the drain pump 48, and the drain pipe 49 are also the same as those in the first embodiment.

As shown in FIG. 16 and FIG. 19, the drain pan 314 is placed so as to cover the underside of the indoor heat exchanger 341.

As shown in FIG. 16 and FIG. 19, the float switch 311 is placed on the upper side of the drain pan 314 and starts and stops the drive control of the drain pump 48 by grasping the water level of the condensed water that has accumulated in the drain pan 314.

The indoor unit casing 350 has a first side surface 50*a* in which a first suction port 51 for taking inside the air in the space on the ceiling backside is disposed, a second side surface 50*b* in which a second suction port 52 is disposed, a maintenance surface 50*d* for performing maintenance, a third side surface 50*c* that opposes the maintenance surface 50*d*, an undersurface 350*e* in which a blow-out port 355 for blowing out the conditioned air into the room is disposed, and hanging brackets 59 for fixing the indoor unit 301 to the ceiling backside in a hanging state. These hanging brackets 59 are formed so as to project outward at four places on outer sides of diagonal lines of the indoor unit casing 350. The first side surface 50*a* in which the first suction port 51 is disposed and the second side surface 50*b* in which the second suction port 52 is disposed are positioned so as to oppose each other. The first air filter 361 is placed on the inner side of the first suction port 51 in the first side surface 50*a* so as to act on the sucked-in air. Likewise, the second air filter 362 is placed on the inner side of the second suction port 52 in the second side surface 50*a* so as to act on the sucked-in air.

A first air filter take-out opening 356*t* is disposed near the left-side end portion of the maintenance surface 50*d* as seen in a side view seen from outside, and a second air filter take-out opening 357*t* is disposed near the right-side end portion of the maintenance surface 50*d*. These are openings with shapes following the thickness and height dimensions of the end portions of the first air filter 361 and the second air filter 362 and are configured such that the first air filter 361 and the second air filter 362 may be freely inserted into the openings and removed from the openings by pulling out the first air filter 361 and the second air filter 362 in a perpendicular direction of the maintenance surface 50*d*.

Figure 20:
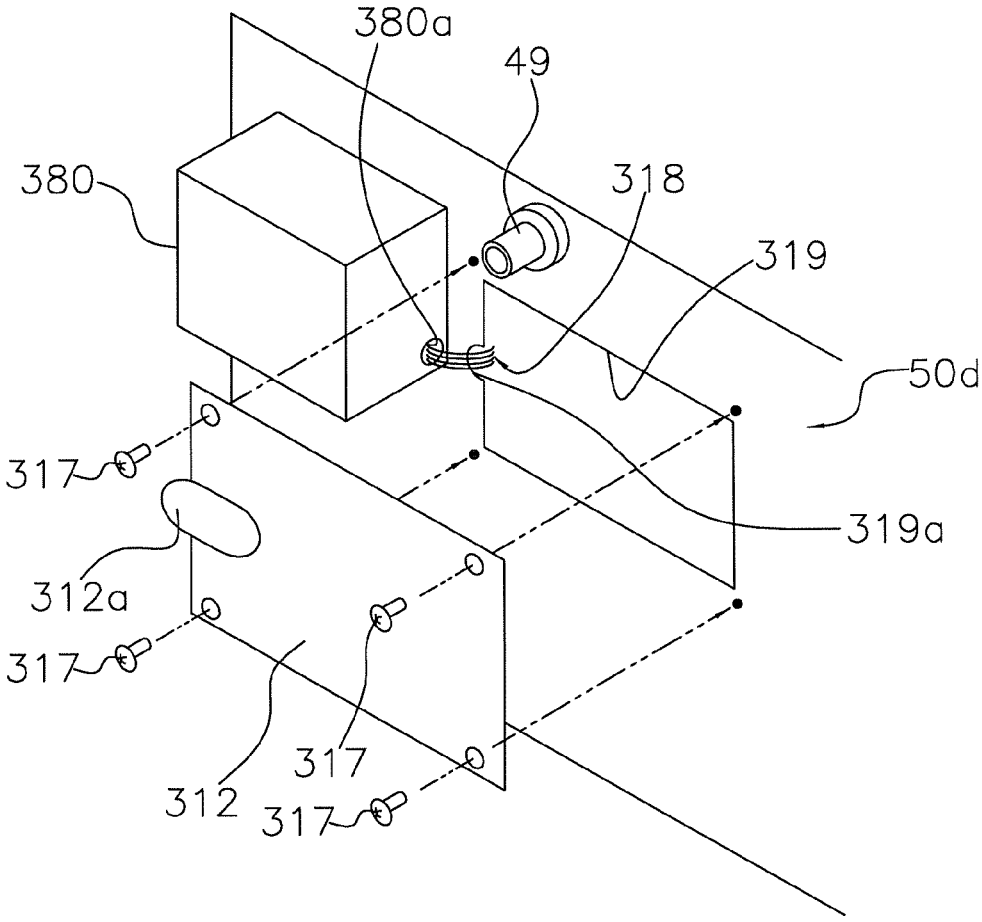
FIG. 20 is an external perspective view of a state where an access hole cover in the maintenance surface of the ceiling-embedded air conditioning indoor unit of the third embodiment has been removed.
Figure 21:
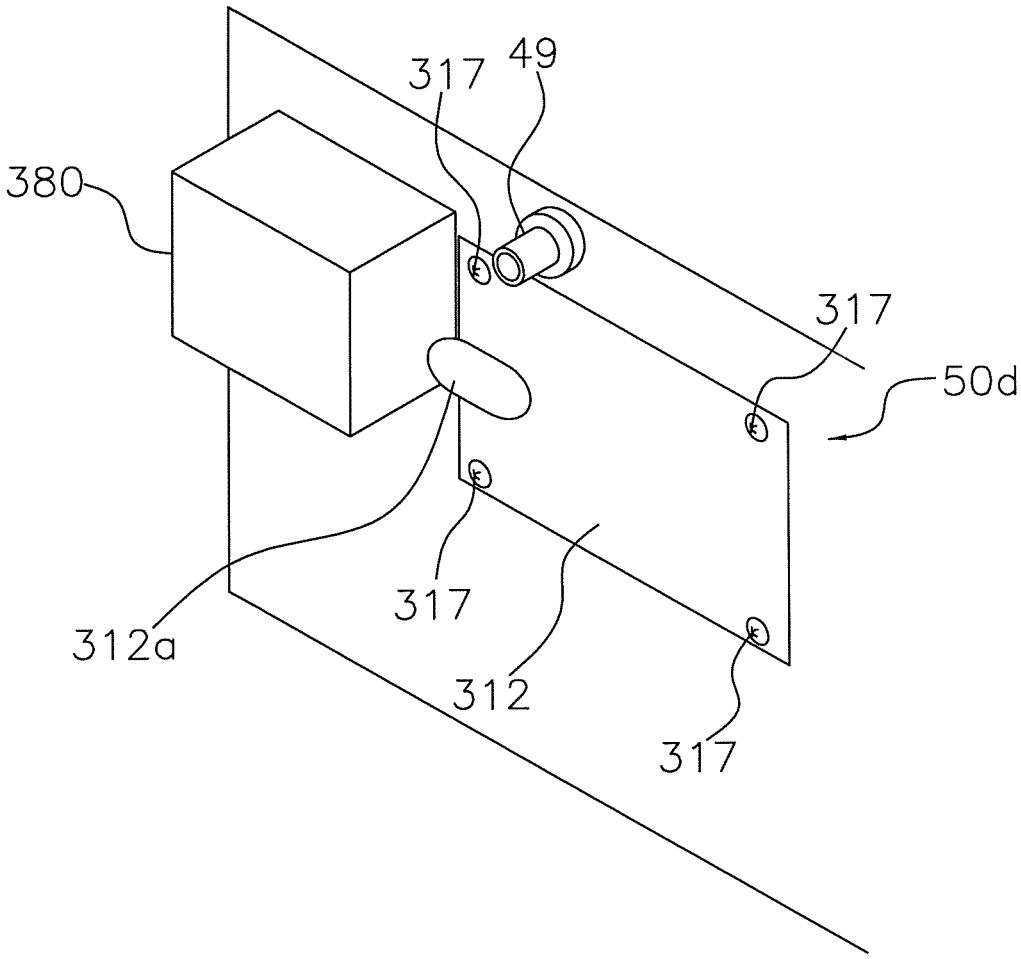
FIG. 21 is an external perspective view of a state where the access hole cover in the maintenance surface of the ceiling-embedded air conditioning indoor unit of the third embodiment has been attached.

Further, the electrical component box 380, an access port 319, and an access port cover 312 are disposed on the outer side of the maintenance surface 50*d*. The side surface of the electrical component box 380 on the indoor heat exchanger 341 side is configured by part of the maintenance surface 50*d* of the indoor unit casing 350. The other surfaces of the electrical component box 380 are configured by plate-like members placed on the outer side of the indoor unit casing 350. A control board for controlling each configural part inside the indoor unit casing is placed in the electrical component box 380. The access port 319 is an opening penetrating the maintenance surface 50*d* in its plate thickness direction near the center of the maintenance surface 50*d*, and a user or a service engineer can easily access the inside of the indoor unit casing 350 from the maintenance surface 50*d* side via this opening. This access port 319 preferably has a width direction equal to or greater than 30 cm and a height direction equal to or greater than 20 cm and more preferably has a width direction equal to or greater than 50 cm and a height direction equal to or greater than 40 cm. The access port cover 312 is a cover that covers this access port 319 and, as shown in FIG. 20 which shows an opened state and FIG. 21 which shows a closed state, is screwed by screws 317 near the four corners of the access port 319. The access port cover 312 has a wiring guard portion 312*a* in which the area near a side end portion of the electrical component box 380 bulges outward. The access port 319 has a cutout portion 319*a* that projects outward near the end portion on the side where the electrical component box 380 is placed. Further, as shown in FIG. 20, the electrical component box 380 has an opening 380*a* that penetrates the electrical component box 380 in its left-right direction near the inner side of the surface on the access port cover 312 side. Additionally, in order to be able to connect various types of connection wires 318 from the inside of the indoor unit casing 350 to the control board and so forth inside the electrical component box 380 even in a state where the access port cover 312 is closed, the various types of wires 318 are passed near the cutout portion 319*a* on the inner side of the wiring guard portion 312*a* of the access port cover 312, passed through the opening 380*a* in the electrical component box 380, and extend to the control board and so forth inside the electrical component box 380. These various types of wires 318 include, for example, wires that extend from the drain pump 48, the float switch 311, the motor-driven valve 315, the fan motor 342*m*, and a thermistor (not shown) and so forth.

One end and the other end of the indoor heat exchanger 341 as seen in a top view are both placed near the maintenance surface 50*d* side. A one-end-side support plate 350*x* is disposed on one side of the indoor heat exchanger 341, and an other-end-side support plate 350*y* is disposed on the other end side of the indoor heat exchanger 341. The one-end-side support plate 350*x* and the other-end-side support plate 350*y* penetrate the heat transfer pipe in its plate thickness direction, extend to the maintenance surface 50*d* side of the indoor unit casing 350, and are fixed at the maintenance surface 50*d*. The one-end-side support plate 350*x* and the other-end-side support plate 350*y* extend in the vertical direction and work together with the maintenance surface 50*d* of the indoor unit casing 350 to partition an upwind side and a downwind side of the indoor heat exchanger 341. Because of this, the portion of the maintenance surface 50*d* surrounded by the fixed portion of the one-end-side support plate 350*x* and the fixed portion of the other-end-side support plate 350*y* becomes positioned on the downwind side of the indoor heat exchanger 341. Further, the portion of the maintenance surface 50*d* other than the portion surrounded by the fixed portion of the one-end-side support plate 350*x* and the fixed portion of the other-end-side support plate 350*y* becomes positioned on the upwind side of the indoor heat exchanger 341.

The access port 319 disposed in the maintenance surface 50*d* is disposed so as to be positioned in the portion surrounded by the fixed portion of the one-end-side support plate 350*x* and the fixed portion of the other-end-side support plate 350*y*. For this reason, the access port 319 is positioned on the downwind side of the indoor heat exchanger 341. As mentioned above, when performing maintenance on the drain pump 48, the portions of the drain pipe 49 and the gas pipe 31 and the liquid pipe 32 inside the indoor unit casing 350, the float switch 311, the motor-driven valve 315, and the fan motor 342*m*, the maintenance work can be performed just by accessing them from the access port 319 side. For this reason, the trouble of changing the direction of access at the time of maintenance can be saved.

As mentioned above, the electrical component box 380 disposed on the maintenance surface 50*d* has a side surface on the indoor heat exchanger 341 side that is configured by part of the maintenance surface 50*d* of the indoor unit casing 350 and other surfaces configured by plate-like members placed on the outer side of the indoor unit casing 350. Additionally, the portions of the electrical component box 380 where the other surfaces configured by the plate-like members and the maintenance surface 50*d* contact each other are all positioned on the upwind side with respect to the one-end-side support plate 350*x*. That is, the side surface of the electrical component box 380 on the indoor heat exchanger 341 side is positioned on the upwind side of the indoor heat exchanger 341 and is exposed to the air flow environment before heat exchange is performed. Further, the other surfaces of the electrical component box 380 configured by the plate-like members are likewise positioned on the upwind side of the indoor heat exchanger 341 and are exposed to the air flow environment before heat exchange is performed. For this reason, not part but all of the electrical component box 380 becomes positioned on the upwind side of the indoor heat exchanger 341 and exposed to the air flow environment before heat exchange is performed. For this reason, in the electrical component box 380, it is difficult for a temperature difference resulting from differences in the surrounding environment to arise, so it is difficult for dew condensation to form.

The gas pipe 31 and the liquid pipe 32 extending from this indoor heat exchanger 341 penetrate the maintenance surface 50*d* and extend outward. Further, the drain pipe 49 likewise penetrates the maintenance surface 50*d* and extends outward. Additionally, as shown in FIG. 16 and FIG. 19, the motor-driven valve 315 is placed inside the indoor unit casing 350 near the maintenance surface 50*d* side.

The undersurface 350*e* has substantially the same outer edge shape and size as the outer edge shape and size of the one ceiling panel 7 mentioned in the first embodiment. This undersurface 350*e* can be easily installed without deteriorating the design of the ceiling surface by replacing the ceiling panel 7 mounted in the portion of the ceiling in which the indoor unit 301 is to be installed. The undersurface 350*e* of the indoor unit casing 350 has a blow-out port configuring panel 355*a*. This blow-out port configuring panel 355*a* is positioned on the inner side of the blow-out port 355 to shape the blow-out port 355 disposed around it and the outer edge of the blow-out port configuring panel 355*a* configures the edge on the inner side of the blow-out port 355. In this way, in the undersurface 350*e* of the indoor unit casing 350, all of the outer edge of the blow-out port configuring panel 355*a* configures the inner edge of the blow-out port 355, so the supply of the conditioned air to the room via the blow-out port 355 can be performed in all directions of 360° with respect to the axis of rotation of the indoor fan 342.

The indoor fan 342 is a turbo fan placed inside the indoor unit casing 350 such that its axial direction substantially coincides with the vertical direction. The indoor fan 342 forms air flows F301 in which the indoor fan 342 takes in the air on the ceiling backside via the suction ports 51 and 52 in the indoor unit casing 350 and blows out the air into the room via the blow-out port 355. By employing a turbo fan in this way, it becomes easy to ensure the air volume even in a case where the indoor unit 301 has been miniaturized.

A bellmouth 342*b* is disposed above the outer edge of the indoor fan 342 at the time it is driven to rotate. This bellmouth 342*b* can gently bend the traveling direction of the air flows F301 taken in via the first suction port 51 and the second suction port 52 and guide the air flows to the blow-out port 355. This bellmouth 342*b* has a shape in which it cylindrically covers the air flows F301 from outside in the radial direction of rotation of the indoor fan 342 and is formed such that its radial direction length becomes larger with increasing distance upward. In this way, because the bellmouth 342 with this shape is placed above the indoor fan 342, the taking-in of the air via the first suction port 51 and the second suction port 52 in the indoor unit casing 350 and the supply of the conditioned air to the room via the blow-out port 355 can be made easy.

Additionally, the indoor fan 342 is placed such that its outer edge as seen in a top view is positioned on the inner side of the blow-out port 355. For this reason, a radial direction component can be created in the traveling direction of the air flows F301 after the air flows F301 have passed through the indoor fan 342. Moreover, the air flows F301 that have come to have the radial direction component because of the indoor fan 342 pass through the blow-out port 355 that is placed further outward, whereby the conditioned air can be provided to the room while the radial direction component is maintained or increased. In this way, the air flows F301 can be made to include the radial direction component, and the air flows F301 do not just have a component leading from the blow-out port 355 straight downward, so the draft sensation imparted to the user in the room can be reduced.

(Insertion and Removal of First Air Filter 361 and Second Air Filter 362)

As shown in FIG. 16, the first air filter 361 and the second air filter 362 can be easily inserted and removed by accessing them from the outer side of the maintenance surface 50*d* through the first air filter take-out opening 356*t* and the second air filter take-out opening 357*t* and pulling them out in the perpendicular direction of the maintenance surface 50*d*. Because of this, it becomes possible to perform maintenance work such as replacement and cleaning in regard to both the first air filter 361 and the second air filter 362 just by accessing them from the maintenance surface 50*d* side. For this reason, there is no longer the need to access the air filters from another surface side of the indoor unit casing 350, such as the first side surface 50*a*, the second side surface 50*b*, or the third side surface 50*c*, and maintenance work such as replacement can be performed just by accessing the air filters from the maintenance surface 50*d* side.

A cover that is capable of opening and closing the first air filter take-out opening 356*t* and a cover that is capable of opening and closing the second air filter take-out opening 357*t* may also be disposed as needed.

<Characteristics of Ceiling-Embedded Air Conditioning Apparatus 301 of Third Embodiment>

(1)

In the indoor unit 301 of the third embodiment, the first air filter take-out opening 356*t* and the second air filter take-out opening 357*t* are disposed on the maintenance surface 50*d* side, so maintenance such as replacement and cleaning can be performed in regard to both the first air filter 361 and the second air filter 362 just by accessing them from the maintenance surface 50*d* side.

(2)

Not only the first air filter take-out opening 356*t* and the second air filter take-out opening 357*t* but also the electrical component box 380, the access port 319, the access port cover 312, the drain pipe 49, the gas pipe 31, and the liquid pipe 32 are gathered together on the maintenance surface 50*d* side, and it becomes possible to perform maintenance on these without having to access them from another surface just by accessing them from the maintenance surface 50*d* side. Additionally, in order to perform such maintenance, it suffices to ensure, only on the maintenance surface 50*d* side, maintenance space such as space in which to be able to take out the first air filter 361 and the second air filter 362, so the installation space can be reduced even in the case of ensuring maintenance space and installing the indoor unit 301. Further, for example, it becomes possible to ensure maintenance space even if a side surface of the indoor unit casing 350 that is not the maintenance surface 50*d* side has been placed near a wall surface in the room.

Additionally, the access port 319 that penetrates the maintenance surface 50*d* in its plate thickness direction is disposed near the center of the maintenance surface 50*d*. This access port 319 is disposed so as to face the space on the inner side of the indoor heat exchanger 341—that is, the space on the downwind side of the indoor heat exchanger 341. For this reason, the motor-driven valve 315, the float switch 311, the drain pump 48, and the thermistor (not shown) and so forth placed in the space on the downwind side of the indoor heat exchanger 341 can be accessed via the access port 319. Further, because the motor-driven valve 315, the float switch 311, the drain pump 48, and the thermistor (not shown) and so forth are placed near the maintenance surface 50*d*, access via the access port 319 becomes even easier. For this reason, a user or a service engineer can easily access the motor-driven valve 315, the float switch 311, the drain pump 48, and the thermistor (not shown) and so forth placed inside the indoor unit casing 350 via this access port 319 in a state where the access port cover 312 has been removed as shown in FIG. 20, so it becomes possible to perform maintenance easily without having to lower the drain pan 314 or the undersurface 350*e* of the indoor unit casing 350 into the room.

(3)

The air flows F301 that are blown out into the room from the blow-out port 355 do not proceed directly toward the place where the user is, but a component leading outward in the radial direction with respect to the axis of rotation of the indoor fan 342 can be included in the component of the traveling direction. For this reason, the draft sensation imparted to the user in the room can be reduced.

Moreover, in this indoor unit 301, the traveling direction of the conditioned air that is blown out is not abruptly changed, but the blow-out port 355 and the indoor fan 342 are made to cooperate to direct the traveling direction of the air flows F301 gradually outward in the radial direction. For this reason, ventilation resistance can be kept small compared to a case where the traveling direction of the air flows F1 formed by the indoor fan 42 that is a propeller fan is changed outward in the radial direction abruptly by a rectifier blade or the like placed in the blow-out port 55 as shown in FIG. 3, for example. In this way, by keeping the ventilation resistance small, the reach of the conditioned air can be increased, and it also becomes possible to keep the blowing sound produced at the time of operation small.

Further, in the indoor unit 301, by placing the blow-out port configuring panel 355*a* below the indoor fan 342, the underside of the indoor fan 342 can be closed off, and a flat impression can be imparted to the design of the indoor unit 301 in a case where it is seen from the room.

Moreover, whereas the bellmouth 942*b* of the conventional indoor unit 901 is placed below the indoor fan 942 as shown in FIG. 25, the bellmouth 342*b* in the indoor unit 301 of the third embodiment is placed above the indoor fan 342 as shown in FIG. 17. Because of this, the taking-in of the air via the first suction port 51 and the second suction port 52 in the indoor unit casing 350 and the supply of the conditioned air to the room via the blow-out port 355 can be realized while suppressing the ventilation resistance.

(4)

In a case where, unlike in the third embodiment, the electrical component box were to be placed in a position where it touched both the air before heat exchange and the air after heat exchange, a temperature difference would arise between a certain portion of the electrical component box and its other portion, and there would be the fear that dew condensation would form.

In contrast, the electrical component box 380 of the third embodiment is positioned on the upwind side of the indoor heat exchanger 341, and all of the electrical component box 380 is exposed to the air flow environment before heat exchange is performed. For this reason, a temperature difference arising in the electrical component box 380 can be suppressed, and the formation of dew condensation can be suppressed even without disposing a heat insulating material on the inner surface of the electrical component box 80.

<Modifications of Third Embodiment>

The third embodiment of the present invention has been described above on the basis of the drawings, but the specific configurations thereof are not limited to this and can be changed without departing from the gist of the invention.

(A)

In the third embodiment, a case where there were two suction ports—the first suction port 51 and the second suction port 52—in the indoor unit casing 350 was taken as an example and described.

However, the present invention is not limited to this.

For example, as described in the second embodiment, the invention may also be configured such that a suction port is in the surface opposing the maintenance surface 50*d*. In this case, as described in the second embodiment, the invention may be configured such that filters are placed in positions corresponding to each suction port, and a mechanism such as described in the second embodiment by which those filters may be inserted and removed by sliding them in the vertical direction may be employed.

Further, as described in modification (B) of the first embodiment, a configuration where insertion and removal of the filters is performed by sliding the filters in the horizontal direction from the side surface opposing the maintenance surface 50*d* may also be employed.

(B)

In the third embodiment, a case where all of the electrical component box 380 disposed on the maintenance surface 50*d* side of the indoor unit casing 350 is placed on the upwind side of the indoor heat exchanger 341 was taken as an example and described.

In contrast, for example, it is alright even if all of the electrical component box is not completely placed on the upwind side of the indoor heat exchanger 341. For example, the electrical component box may also be placed such that a portion equal to or greater than 90% of the outer surface of the electrical component box faces the space on the upwind side of the indoor heat exchanger 341. In this case also, the formation of dew condensation can be suppressed in regard to the portion of the electrical component box positioned on the upwind side of the indoor heat exchanger 341. Because of this, the formation of dew condensation on the electrical component box can be substantially suppressed, and in this case also it becomes possible to omit a heat insulating material.

<Fourth Embodiment>

A ceiling-embedded air conditioning indoor unit 401 pertaining to still another embodiment of the present invention will be described below with reference to the drawings.

Like in the first embodiment, in the fourth embodiment also, an air conditioning apparatus is configured as a result of the ceiling-embedded air conditioning indoor unit 401 being connected via refrigerant pipes to an outdoor unit installed outdoors. Additionally, the ceiling-embedded air conditioning indoor unit 401 is installed in a grid-like ceiling, sucks in and conditions the air on the ceiling backside, and supplies the conditioned air with respect to a room space below the ceiling.

(Ceiling-Embedded Air Conditioning Indoor Unit 401)

Figure 22:
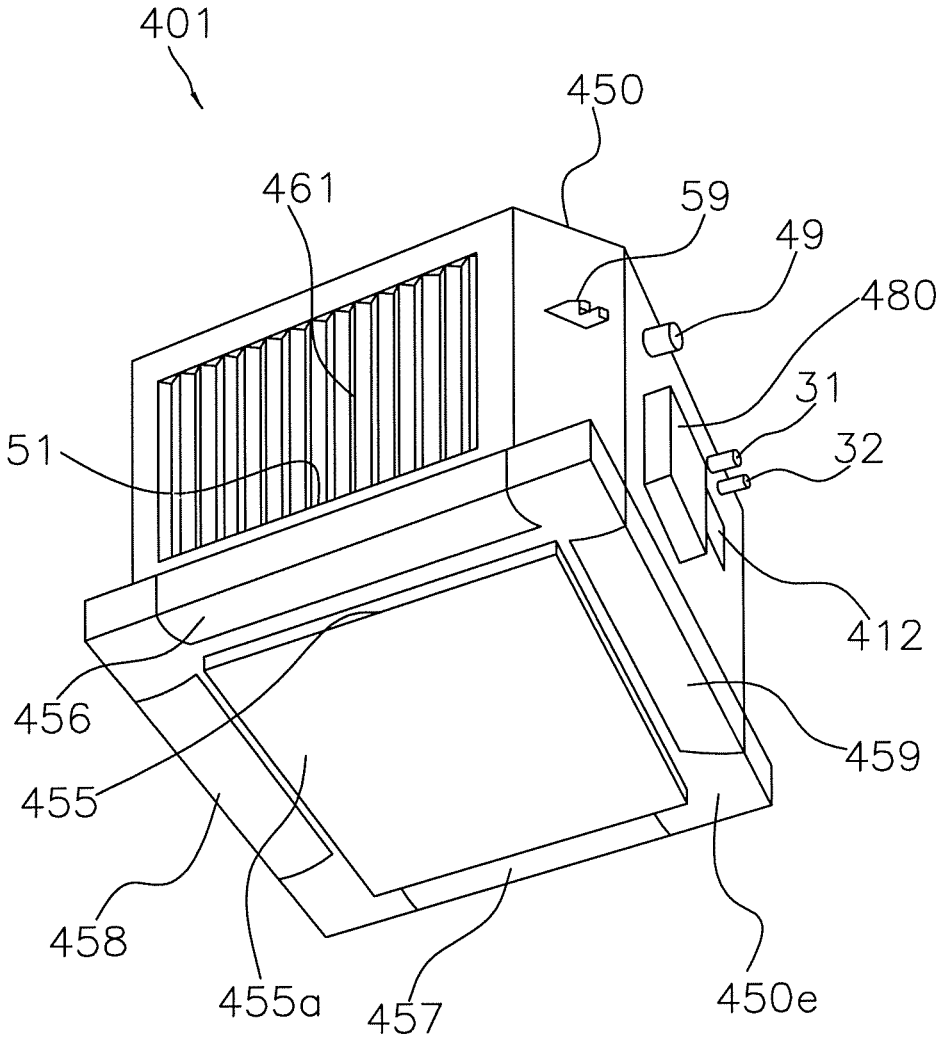
FIG. 22 is an external perspective view of a ceiling-embedded air conditioning indoor unit of a fourth embodiment.
Figure 23:
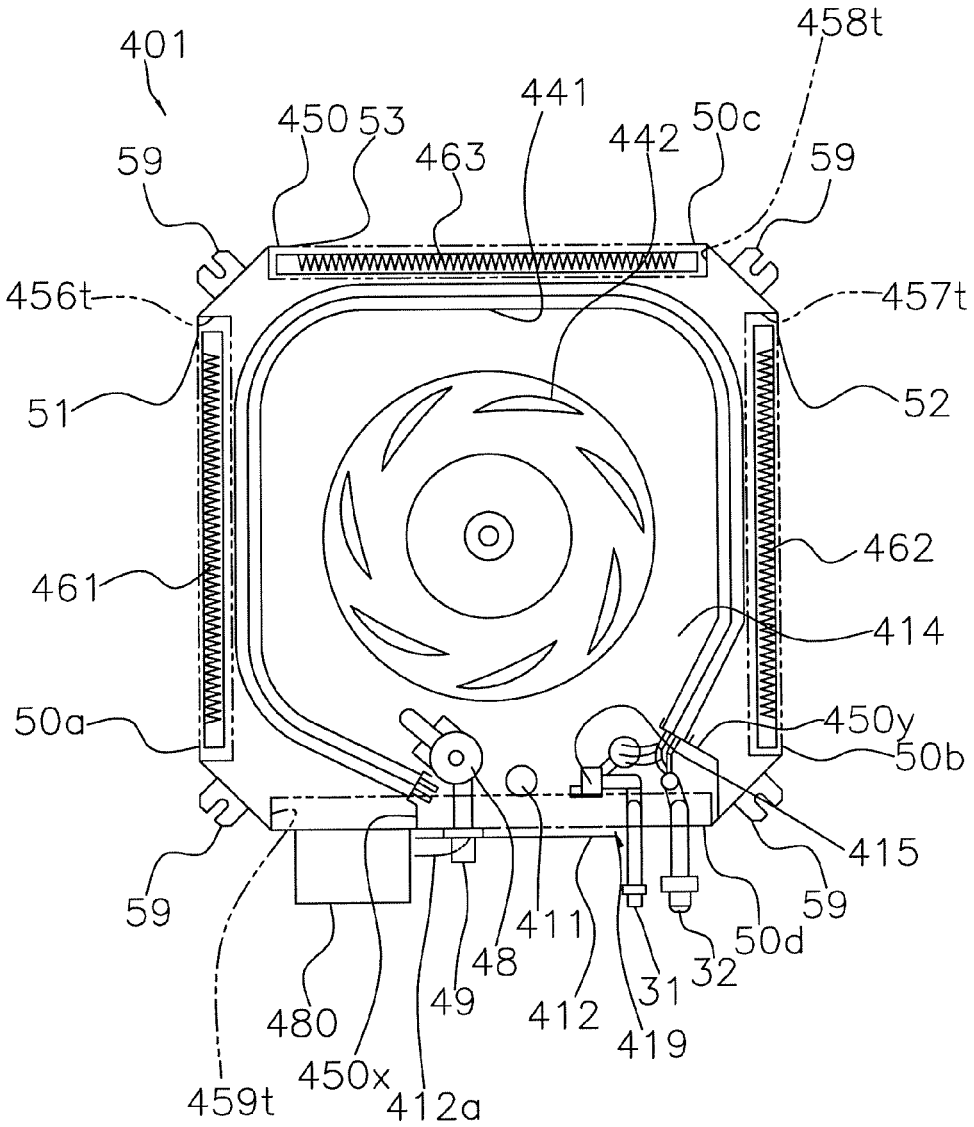
FIG. 23 is a plan sectional view of the ceiling-embedded air conditioning indoor unit of the fourth embodiment.

As shown in the external perspective view in FIG. 22 and the plan sectional view in FIG. 23, the indoor unit 401 is equipped with a gas pipe 31, a liquid pipe 32, an indoor heat exchanger 441, an indoor fan 442, a drain pump 48, a drain pipe 49, an indoor unit casing 450, a first air filter 461, a second air filter 462, a third air filter 463, a motor-driven valve 415, an access port 419, an access port cover 412 having a wiring guard portion 412*a*, a float switch 411, an electrical component box 480, and a drain pan 414 and so forth.

The ceiling in which the indoor unit 401 is installed and the installation method are the same as those in the first embodiment. The gas pipe 31, the liquid pipe 32, the drain pump 48, the drain pipe 49, and hanging brackets 59 are also the same as those in the first embodiment. The motor-driven valve 415, the access port 419, the access port cover 412 having the wiring guard portion 412*a*, the float switch 411, the electrical component box 480, the indoor fan 442, a one-end-side support plate 450*x*, and an other-end-side support plate 450*y* and so forth are the same as the motor-driven valve 315, the access port 319, the access port cover 312 having the wiring guard portion 312*a*, the float switch 311, the electrical component box 380, the indoor fan 342, the one-end-side support plate 350*x*, and the other-end-side support plate 350*y* of the third embodiment.

The indoor heat exchanger 441 is placed so as be along a first side surface 50*a*, a second side surface 50*b*, and a third side surface 50*c* excluding both end portions placed on a maintenance surface 50*d* side inside the indoor unit casing 450 which has a substantially quadrilateral shape as seen in a plan view.

As shown in FIG. 23, the drain pan 414 is placed so as to cover the underside of the indoor heat exchanger 441.

The indoor unit casing 450 has the first side surface 50*a* in which a first suction port 51 for taking inside the air in the space on the ceiling backside is disposed, the second side surface 50*b* in which a second suction port 52 is disposed, the maintenance surface 50*d* for performing maintenance, the third side surface 50*c* in which a third suction port 53 is disposed and which opposes the maintenance surface 50*d*, and an undersurface 450*e* in which a blow-out port 455 for blowing out the conditioned air into the room is disposed and which serves as one member that is independent. The first side surface 50*a* in which the first suction port 51 is disposed and the second side surface 50*b* in which the second suction port 52 is disposed are positioned so as to oppose each other. The first air filter 461 is placed on the inner side of the first suction port 51 in the first side surface 50*a* so as to act on the sucked-in air. Likewise, the second air filter 461 is placed on the inner side of the second suction port 52 in the second side surface 50*b* so as to act on the sucked-in air. Further, the third air filter 463 is placed on the inner side of the third suction port 53 in the third side surface 50*c* so as to act on the sucked-in air.

The undersurface 450*e* has substantially the same outer edge shape and size as the outer edge shape and size of the one ceiling panel 7 mentioned in the first embodiment. This undersurface 450*e* can be easily installed without deteriorating the design of the ceiling surface by replacing the ceiling panel 7 mounted in the portion of the ceiling in which the indoor unit 401 is to be installed. The undersurface 450*e* of the indoor unit casing 450 has a blow-out port configuring panel 455*a*. This blow-out port configuring panel 455*a* is positioned on the inner side of the blow-out port 455 to shape the blow-out port 455 disposed around it, and its outer edge configures the edge on the inner side of the blow-out port 455.

In this undersurface 450*e*, as indicated by the one-dotted chain lines in FIG. 23, there are disposed a first air filter take-out opening 456*t* that is disposed below the first air filter 461, a second air filter take-out opening 457*t* that is disposed below the second air filter 462, and a third air filter take-out opening 458*t* that is disposed below the third air filter 463. Further, in the undersurface 450*e*, as shown in FIG. 22, there are disposed a first filter cover 456 for enabling the first air filter take-out opening 456*t* to be opened and closed, a second filter cover 457 for enabling the second air filter take-out opening 457*t* to be opened and closed, and a third filter cover 458 for enabling the third air filter takeout opening 458*t* to be opened and closed. The first air filter take-out opening 456*t* and so forth all configure openings that are slightly larger than the shape and dimensions of the first air filter 461 and so forth as seen in a plan view. For example, by opening the first filter cover 456, insertion and removal of the first air filter 461 via the first air filter take-out opening 456*t* from the room becomes possible, and maintenance such as replacement and cleaning becomes possible.

Moreover, in the undersurface 450*e*, an opening 459*t* is disposed near the maintenance surface 50*d* side in a position opposing the third air filter take-out opening 458*t* so as to ensure symmetry as seen in a bottom view. Additionally, as shown in FIG. 22, a cover 459 for enabling this opening 459*t* to be opened and closed is disposed. However, no filter or the like exists above the opening 459*t* and the cover 459.

<Characteristics of Ceiling-Embedded Air Conditioning Apparatus 401 of Fourth Embodiment>

In the indoor unit 401 of the fourth embodiment, the undersurface 450*e* of the indoor unit casing 450 configures an independent member, has a shape in which the symmetry of the first filter cover 456 and so forth is ensured as seen in a bottom view, and has a structure in which openings (the first air filter take-out opening 456*t*, the second air filter take-out opening 457*t*, the third air filter take-out opening 458*t*, and the opening 459*t*) for inserting and removing the filters are placed on all four sides. For this reason, for example, it is not necessary for a person about to install the indoor unit 401 in the ceiling to check the directionality of the undersurface 450*e* when replacing the ceiling panel 7 with the undersurface 450*e* of the indoor unit casing 450 and installing the indoor unit 401, and the burden of the installation work is alleviated.

That is, as long as the undersurface 450*e* has a form that can be fitted into the portion where the ceiling panel 7 had existed, no matter which direction the undersurface 450*e* is installed, no matter how the other parts (e.g., the first air filter 461, the second air filter 462, the third air filter 463, the indoor heat exchanger 441, etc.) have been placed above the undersurface 405*e*, it becomes possible to allow the functions of these other parts to be exhibited, and insertion and removal of the first air filter 461 and so forth from the room also becomes possible.

In this way, in a case where a user or a service engineer can reach the inside of the indoor unit casing 450 via the fourth air filter take-out opening 459*t* above which no air filter or the like exists, it becomes possible for the user or the service engineer to perform maintenance on the motor-driven valve 415, the float switch 411, the drain pump 48, and the thermistor (not shown) placed so as to be gathered together on the maintenance surface 50*d* side of the inside of the indoor unit casing 450 without having to lower the drain pan 414 or the undersurface 450*e* of the indoor unit casing 450 into the room.

<Other>

Embodiments of the present invention have been described above by way of several examples, but the present invention is not limited to these. For example, combined implementations obtained by appropriately combining different portions of the above embodiments in a scope implementable by persons skilled in the art from the above description are also included in the present invention.

Industrial Applicability

By utilizing the present invention, miniaturizing is possible while keeping a short circuit small, so the present invention is particularly useful in a ceiling-embedded air conditioning indoor unit installed in a ceiling.

The invention claimed is:

1. A ceiling-embedded air conditioning indoor unit arranged to condition air in a space above a ceiling of an air conditioning target space and arranged to supply the conditioned air to the air conditioning target space, with the ceiling having a grid shaped frame, the ceiling-embedded air conditioning indoor unit comprising:

an indoor unit casing having a side surface portion being rectangle shaped as seen in a plan view, the side surface portion having a first side surface having a first suction port, a second side surface opposing the first side surface and having a second suction port, a third side surface, and a non-suction side surface opposing the third side surface and having no suction port, and an undersurface portion being rectangle shaped with each side being equal to or less than 600 mm long;

a fan placed inside the indoor unit casing to form an air flow leading from the first suction port and the second suction port to the blow-out port; and a heat exchanger having a first part placed between the fan and the suction port, an outer edge of the undersurface of the indoor unit casing being placed so as to be positioned on an inner side of an inner edge of the frame or so as to be along the frame, a first portion of the heat exchanger adjacent the non-suction side surface being placed so as to become closer to the first side surface with increasing distance away from the non-suction side surface, and a second portion of the heat exchanger adjacent the non-suction side surface being placed so as to become closer to the second side surface with increasing distance away from the non-suction side surface.

2. The ceiling-embedded air conditioning indoor unit according to claim 1, wherein the outer edge of the undersurface of the indoor unit casing is supported by the frame.

3. The ceiling-embedded air conditioning indoor unit according to claim 1, wherein the undersurface of the indoor unit casing is substantially square shaped.

4. The ceiling-embedded air conditioning indoor unit according to claim 1, wherein the ceiling has a ceiling panel placed such that an outer edge of the ceiling panel is positioned on the inner side of the inner edge of the frame or is along the frame, and the outer edge of the undersurface of the indoor unit casing is placed so as to be positioned on an inner side of an edge of a cutaway portion of the ceiling panel or so as to follow the edge of the cutaway portion.

5. The ceiling-embedded air conditioning indoor unit according to claim 4, wherein the undersurface of the indoor unit casing includes an undersurface member positioned on a lower end of the indoor unit casing in an installed state and placed so as to face the air conditioning target space.

6. The ceiling-embedded air conditioning indoor unit according to claim 1, wherein the non-suction side surface has an access port that enables access to the inside of the indoor unit casing.

7. The ceiling-embedded air conditioning indoor unit according to claim 1, wherein the heat exchanger has a heat transfer pipe that extends from a first end to a second end, and the first and second ends of the heat transfer pipe are disposed so as to penetrate the non-suction side surface.

8. The ceiling-embedded air conditioning indoor unit according to claim 1, further comprising an electrical component portion arranged and configured to perform drive control of at least the fan, the electrical component portion being placed on an outer side of the non-suction side surface and being fixed to the non-suction side surface.

9. The ceiling-embedded air conditioning indoor unit according to claim 1, further comprising a drain portion arranged to collect drain water arising in the heat exchanger, the drain portion penetrating the non-suction side surface and extending outward therefrom.

10. The ceiling-embedded air conditioning indoor unit according to claim 1, further comprising an electrical component portion arranged and configured to perform drive control of at least the fan, an entirety of a side surface of the electrical component portion on a heat exchanger side being placed so as to be positioned on an upwind side of the heat exchanger in a state where the fan has been driven.

11. The ceiling-embedded air conditioning indoor unit according to claim 1, wherein the indoor unit casing having an access port disposed so as to face a space positioned on a downwind side of the heat exchanger in a state where the fan has been driven to enable access to the inside of the indoor unit casing, the access port communicating with the space inside the heat exchanger through a gap in the heat exchanger.

12. The ceiling-embedded air conditioning indoor unit according to claim 1, further comprising a drain pipe arranged and configured to collect and drain water arising in the heat exchanger; and an electrical component portion arranged and configured to perform drive control of at least the fan, the heat exchanger having a heat transfer pipe that extends from a first end to a second end, the indoor unit casing has a through surface with an access port formed therein to enable access to the inside of the indoor unit casing, and the drain pipe penetrating the through surface, the heat transfer pipe penetrating the through surface, and the electrical component portion being mounted on the through surface.

13. The ceiling-embedded air conditioning indoor unit according to claim 1, wherein an axial direction of the fan is parallel to a perpendicular direction of the undersurface of the indoor unit casing, and the fan is one of a turbo fan or a propeller fan.

14. The ceiling-embedded air conditioning indoor unit according to claim 13, wherein the fan is a turbo fan with an outer edge as seen in a top view placed on an inner side of the blow-out port.

15. The ceiling-embedded air conditioning indoor unit according to claim 1, further comprising a filter placed between the suction port and the heat exchanger, the indoor unit casing having a filter up-and-down accommodation opening arranged and configured so that the filter is insertable and removeable therein by sliding the filter up and down, and a filter cover that covers the filter up-and-down accommodation opening.

16. The ceiling-embedded air conditioning indoor unit according to claim 1, further comprising a filter placed between the suction port and the heat exchanger, the indoor unit casing having filter horizontal accommodation opening arranged and configured so that the filter is insertable and removeable therein by sliding the filter in a substantially horizontal direction.

17. The ceiling-embedded air conditioning indoor unit according to claim 1, further comprising two or more filters placed between the suction port and the heat exchanger in positions on at least two sides of four sides of a substantially quadrilateral shape as seen in a top view, the undersurface of the indoor unit casing having a symmetrical shape as seen in a bottom view by having filter up-and-down accommodation openings disposed below the two or more filters such that the filters become capable of being inserted and removed by sliding the filters up and down, filter covers that cover the filter up-and-down accommodation openings, an additional opening that is disposed below a portion configuring a side of the four sides of the substantially quadrangular shape on which the filters are not disposed and which is of a size equal to the filter up-and-down accommodation openings, and an additional cover that covers the additional opening and is of a size equal to the filter covers.

18. The ceiling-embedded air conditioning indoor unit according to claim 1, wherein the heat exchanger is placed so as to surround a radial direction outer side of the fan with respect to an axis of rotation of the fan, and a width of the heat exchanger in the radial direction with respect to the axis of rotation of the fan is shorter than a width of the heat exchanger in a vertical direction.

* * * * *